US011391522B2

(12) United States Patent
Nitta

(10) Patent No.: US 11,391,522 B2
(45) Date of Patent: Jul. 19, 2022

(54) TUBE AND CHAMBER TYPE HEAT EXCHANGE APPARATUS HAVING AN ENHANCED MEDIUM DIRECTING ASSEMBLY

(71) Applicant: Takeyoshi Nitta, Upland, CA (US)

(72) Inventor: Takeyoshi Nitta, Upland, CA (US)

(73) Assignee: MIKUTAY CORPORATION, Ontario, CA (US)

( * ) Notice: Subject to any disclaimer, the term of this patent is extended or adjusted under 35 U.S.C. 154(b) by 173 days.

(21) Appl. No.: 16/853,582

(22) Filed: Apr. 20, 2020

(65) Prior Publication Data

US 2021/0325130 A1 Oct. 21, 2021

(51) Int. Cl.

| | |
|---|---|
| ***F28F 1/40*** | (2006.01) |
| ***F28F 9/22*** | (2006.01) |
| ***F28F 1/04*** | (2006.01) |

(52) U.S. Cl.

CPC ..... *F28F 1/40* (2013.01); *F28F 1/04* (2013.01); *F28F 9/22* (2013.01); *F28F 2009/222* (2013.01)

(58) Field of Classification Search

CPC ..... F28F 1/04; F28F 1/38; F28F 1/40; F28F 9/22; F28F 2009/222

See application file for complete search history.

(56) References Cited

U.S. PATENT DOCUMENTS

| | | | | |
|---|---|---|---|---|
| 3,051,453 | A * | 8/1962 | Sluijters | B01F 5/0641 366/337 |
| 4,497,751 | A * | 2/1985 | Pluss | B01D 3/24 261/112.1 |
| 5,522,661 | A * | 6/1996 | Tsukada | B01F 5/0617 366/337 |
| 5,758,967 | A * | 6/1998 | King | B01F 5/0618 138/39 |
| 7,040,802 | B2 * | 5/2006 | Fuglister | B01F 5/0618 366/337 |
| 8,393,782 | B2 * | 3/2013 | Smith | B01F 5/0451 366/181.5 |
| 10,202,880 | B2 * | 2/2019 | Kuroyanagi | F28F 3/027 |
| 2005/0219947 | A1 * | 10/2005 | Carlson | B01F 5/0616 366/337 |
| 2006/0016582 | A1 * | 1/2006 | Hashimoto | F28D 7/1684 165/109.1 |

(Continued)

*Primary Examiner* — Devon Russell

(57) ABSTRACT

A heat exchanger having a chamber assembly defining a hollow space within, the chamber assembly having an input and a discharge means of a heat exchange medium. Disposed within the chamber assembly is a medium directing assembly. The medium directing assembly defined by a plurality of panel members arranged in a longitudinally extended manner positioned at an acute angle relative to the chamber assembly longitudinal axial characteristics, having an angled lateral edges whereby a first and a second longitudinal ends are provided with wider lateral width, while the medial section of the medium directing assembly is substantially narrower. The medium directed assembly providing a plurality of serially interconnected chambers within the chamber assembly to maximize chamber assembly and heat exchange medium interface, a structured flow path arrangement for the heat exchange medium, as well as means to energize the flow of the heat exchange medium for the desired results.

28 Claims, 7 Drawing Sheets

(56) References Cited

U.S. PATENT DOCUMENTS

| | | | | |
|---|---|---|---|---|
| 2015/0114609 | A1* | 4/2015 | Wang | F28F 1/40<br>165/109.1 |
| 2015/0129184 | A1* | 5/2015 | Alhazmy | F28F 7/02<br>165/168 |
| 2019/0085795 | A1* | 3/2019 | Nitta | F28D 1/06 |
| 2019/0093956 | A1* | 3/2019 | Jensen | F28D 7/0091 |

* cited by examiner

TUBE AND CHAMBER TYPE HEAT EXCHANGE APPARATUS HAVING AN ENHANCED MEDIUM DIRECTING ASSEMBLY

BACKGROUND OF THE INVENTION

The present invention relates to heat exchangers utilized to transport heat from one heat exchange medium to another, and more specifically related to a tube and chamber type heat exchange apparatus having a medium directing assembly disposed within a chamber assembly, utilizing the medium directing assembly to enhance the flow pattern of a heat exchange medium for the desired effect.

DISCUSSION OF THE RELATED ART

In a typical tube and chamber type heat exchanger, a hollow chamber assembly is provided with a medium directing insert disposed within the chamber assembly to facilitate the desired flow of a heat exchange medium within the chamber assembly. Generally, at least two heat exchange mediums are utilized in a tube and chamber type heat exchanger to facilitate heat transfer between the two heat exchange mediums. A first heat exchange medium is typically fed inside the chamber assembly while a second heat exchange medium is directed to flow outside the chamber assembly. The chamber assembly generally acts as a conduit to facilitate heat transfer between the first heat exchange medium and the second heat exchange medium.

The chamber assembly is generally a hollow body, provided with a medium directing insert disposed within the chamber assembly to divert the flow of the first heat exchange medium in desired ways, generally resulting in two divergent semi-circular flows as a result of the first heat exchange medium being directed to impact the medium directing insert. The chamber assembly is generally provided with a chamber inlet and a chamber outlet as means to introduce the first heat exchange medium into the chamber assembly, then to discharge the first heat exchange medium out of the chamber assembly, respectively. The chamber inlet and the chamber outlet are further utilized to obtain the desired flow of the first heat exchange medium, for the desired heat transfer performance enhancements. Typically, the chamber inlet, as well as the chamber outlet, is configured to take a different shape than the chamber assembly.

The medium directing insert generally may be configured as a rectangularly shaped single planar panel member, having a first planar side and a second planar side. The first planar side is generally positioned within the chamber assembly at an angle relative to the longitudinal axial characteristics established by the chamber assembly, while generally facing the chamber inlet. The second planar side is similarly positioned within the chamber assembly at an angle, while generally facing the chamber outlet. The medium directing insert is provided with a first lateral edge and a second lateral edge, the respective lateral edges of the medium directing insert generally arranged to align to a common plane. The respective lateral edges are further generally located spaced apart from the chamber assembly, permitting the first heat exchange medium to flow generally perpendicularly to the longitudinal axial characteristics established by the chamber assembly. A first vertical edge of the medium directing insert, as well as a second vertical edge of the medium directing insert, generally engages the chamber assembly.

The medium directing insert is generally utilized within the chamber assembly to induce desired mixing and agitating effect to the first heat exchange medium introduced into the chamber assembly, resulting in improved convective heat transfer. Generally, all the first heat exchange medium introduced into the chamber assembly from the chamber inlet is directed to impact the first planar side of the medium directing insert to maximize the agitating effect. Improved convective heat transfer is generally known in the art to enhance heat transfer effectiveness of the heat exchange medium, which in turn enhances the effectiveness of the overall heat exchanger. Heat can be transferred from inside the heat exchanger to the outside, or vice versa, dependent upon the application of the heat exchanger.

Conventional tube and chamber type heat exchanger typically induce relatively high pressure drop to the first heat exchange medium directed inside the chamber assembly, as the design objective of a typical tube and chamber type heat exchanger generally centers around maximizing heat transfer effectiveness in a relatively short longitudinal chamber assembly span. Such a design objective may afford to realize smaller heat exchanger size relative to a conventional heat exchanger of the same heat transfer capacity. However, there may be drawbacks to the design methodology, such as higher pressure drop effect as noted earlier. In a typical tube and chamber type heat exchanger, the first heat exchange medium is generally directed into the chamber assembly in an initial line of flow to impact the first planar side of the medium directing insert. The first heat exchange medium is then generally directed in a second line of flow by the medium directing insert, generally in an axially perpendicular fashion in relation to the initial line of flow. The medium directing insert then further facilitates a third line of flow, entailing lateral circumvention of the medium directing insert, generally in a two laterally divergent semi-circular flow. The third line of flow generally follows the contour of the chamber assembly, generally perpendicularly to the initial line of flow. The third line of flow is generally terminated once the flow of the first heat exchange medium is diverted back towards the medium directing insert, now generally directed towards the second planar side of the medium directing insert. Once the first heat exchange medium reaches the second planar side of the medium directing insert, the flow direction is generally redirected perpendicularly from the third line of flow to the flow direction that generally conforms to the initial line of flow, prior to discharge of the first heat exchange medium out of the chamber assembly.

All the heat exchange medium flow directional changes facilitated by the medium directing insert involve significant directional changes to the heat exchange medium flow, generally in a perpendicular fashion, which provides enhanced heat transfer effectiveness by improving convective heat transfer effect of the first heat exchange medium. Furthermore, all the flow directional changes are accomplished in a relatively short longitudinal span, making it possible to design a smaller heat exchanger, requiring less packaging space. The design methodology of a typical tube and chamber type heat exchanger is further characterized by generally directing all the first heat exchange medium introduced into the chamber assembly to the first planar side of the medium directing insert, as well as converging all the first heat exchange medium flow on the second planar side of the medium directing insert, prior to discharge out of the chamber assembly. All these characteristics generally result in higher pressure drop to the first heat exchange medium flow, which is not desirable, as higher pressure drop generally results in reduced performance of the heat exchanger, requiring larger pumping mechanism to facilitate a greater flow of the first heat exchange medium. Without a larger pumping mechanism, the heat exchanger may need to be enlarged to attain desired performance, which generally results in higher cost as well as a need for a larger packaging space.

In another prior art heat exchanger, commonly called a tube and fin heat exchanger, the heat exchanger comprises a plurality of tubular members and fin members stacked interchangeably together. The tubular members act as a conduit to transfer heat between a first heat exchange medium flowing outside the tubular members and a second heat exchange medium flowing inside the tubular members. In a typical tube and fin heat exchanger, the first heat exchange medium is directed to flow around the exterior surface of the tube members as well as around fin members. The fin members are attached to the exterior surface of the tube members to supplement the tube members in transferring heat between the first heat exchange medium and the second heat exchange medium, due to limited availability of a primary heat transfer surface provided by the tubular members. As a result, the tube and fin heat exchangers generally rely upon the density of fin members packaged within the heat exchanger to obtain desired heat transfer performance.

The tube and fin heat exchanger typically rely upon the usage of extremely thin planar fin stock material to form the fin members to obtain the desired heat transfer effectiveness. Due to the fragility of fin members in general, the occurrence of damage to the fin members is common, generally diminishing the effectiveness of the heat exchanger, or in some instances, resulting in the heat exchanger being inoperable, due to terminally restricted flow of the first heat exchange medium. Furthermore, higher fin member density generally drastically increases pressure drop of the first heat exchange medium fed through such a contraption, reducing the effectiveness of the heat exchanger as a result. As the performance of the heat exchanger is negatively affected, the heat exchanger may need to be larger in physical size to achieve the desired performance, which generally results in a need for additional raw material, which in turn results in additional weight and cost, as well as requiring additional packaging space for the heat exchanger placement.

Furthermore, secondary heat transfer surfaces in the form of fin members are generally known in the art as less efficient in transferring heat than the primary surfaces provided by the tube members. It is, therefore, desirable to maximize the ratio of primary surfaces over secondary surfaces. With the tube and fin heat exchanger, due to its design configuration, primary surfaces are generally provided only on a top and a bottom vertical portions of a typical flow path for the first heat exchange medium, provided by tubular members, while the two lateral portions of the flow path for the first heat exchange medium are generally provided by the secondary surfaces in the form of fin members, generally diminishing the performance of the heat exchanger relative to heat exchangers with a higher concentration of primary surface for heat exchange purposes.

In another embodiment of the tube and fin heat exchanger, a plurality of fin members are provided in a form of protrusions or wall-like fin extensions wherein a base of such a feature may be attached to a planar base material, typically a planar fin stock material, while a leading edge of the feature is left bare and exposed, without any additional support material to supplement structural rigidity. The leading edge of fins or protrusions in such a design feature is typically purposely left exposed to obtain desired heat exchange medium flow dynamics over the leading edge of the feature. If the leading edge is somehow attached or engaged to some other component within the heat exchanger, the desired effect is typically not achieved, thereby diminishing the heat transfer performance of the heat exchanger as a result. The feature, however, is not desirable as it is prone to deform with the flow, especially with higher velocity flow of the heat exchange medium or when heat is applied. Furthermore, typical protrusions or extension feature utilized in such a heat exchanger design is arranged to be vertically aligned at a steep angle, typically above 45 degrees relative to the base plane that the feature is planted on, to obtain the desired effect, leading to higher pressure drop to the heat exchange medium directed to flow around such feature.

Yet furthermore, a typical tube and fin heat exchanger utilizing protrusions or extensions features rely upon the density of such features populating the flow path for the heat exchange medium in a longitudinal as well as lateral direction. As the number of such features may number in the dozens, or perhaps even hundreds or thousands in a typical design, higher pressure drop effect to the heat exchange medium flowing through such feature is inevitable, especially considering that each and every such feature is contributing to higher pressure drop effect. Furthermore, in a typical tube and fin heat exchanger design utilizing protrusions or extensions feature, the heat exchange medium flow direction is typically dictated by a tubular feature which typically packages the plurality of protrusion or extensions features within, thereby indiscriminatingly applying the heat exchange medium flow through such feature, leaving performance efficiency, especially the utilization of a primary surface provided by the tubular feature, to be something to be desired.

SUMMARY OF THE INVENTION

The present invention is an enhanced tube and chamber type heat exchanger, for use in a heat exchanger application where it is desired to transfer heat from a first heat exchange medium to a second heat exchange medium. The heat exchanger is provided with a chamber assembly, the chamber assembly generally taking a form of a longitudinally extended hollow chamber. In an embodiment of the present invention, the chamber assembly may be formed in a rectangular parallelepiped configuration. The chamber assembly is further provided with a chamber inlet and a chamber outlet, as means to facilitate the flow of the first heat exchange medium into the chamber assembly, and then to discharge the first heat exchange medium out of the chamber assembly, respectively. The chamber inlet is generally located on a first longitudinal end of the chamber assembly, while the chamber outlet is generally located on a second longitudinal end of the chamber assembly. In a typical heat exchanger application, the first heat exchange medium is guided to flow inside the chamber assembly, while the second heat exchange medium is directed to flow around the exterior surface of the chamber assembly, with the material comprising the chamber assembly acting as a primary surface to facilitate the flow of heat between the first heat exchange medium and the second heat exchange medium. Heat may travel into the heat exchanger or out of the heat exchanger, dependent upon the nature of the application of the heat exchanger.

Disposed within the chamber assembly is a medium directing assembly. The medium directing assembly is provided as a means to facilitate desired flow arrangement of the first heat exchange medium directed into the chamber assembly, generally with a desire to improve convective heat transfer effect of the first heat exchange medium by energizing the first heat exchange medium by introducing mixing and eddying effect to the flow, improvement of which is known in the art to generally increase the performance of the overall heat exchanger. The medium directing assembly is also positioned within the chamber assembly to form and locate a plurality of energized first heat exchange medium flow generally adjacent to the interior surface of the chamber body, thereby facilitating greater heat transfer effect by locating the energized flow adjacent to the primary surface that facilitates heat conduction between the first and the second heat exchange medium. The medium directing assembly is further utilized to create and then locate a plurality of flow channels extending generally the longitudinal span of the chamber assembly, locating the flow channels between the chamber assembly and the medium directing assembly, utilizing the plurality of highly energized flow created by the medium directing assembly to facilitate greater heat transfer effect to the first heat exchange medium flowing within the plurality of flow channels without unduly increasing pressure drop effect to the first heat exchange medium.

As the flow channels are located adjacent to the primary surface provided by the chamber body, a greater heat transfer effect can be achieved. The flow channels are generally free of physical obstruction for the longitudinal span of the respective flow channels, minimizing pressure drop effect to the first heat exchange medium. The medium directing assembly is yet further utilized to form a plurality of serially interconnected longitudinally partitioned sections within the chamber assembly to obtain the desired flow of the first heat exchange medium, to ensure that the entire longitudinal span of the chamber assembly is fully utilized, effectively, for heat transfer purposes, thereby maximizing heat transfer potential of the chamber assembly. Select partitioned sections are further utilized to function like an inlet tube and an outlet tube typically used in a conventional tube and chamber type heat exchanger, without having the need to attach separate physical components to the chamber assembly, minimizing cost.

In function, the first heat exchange medium is generally directed to impact the surface of the medium directing assembly to achieve the desired flow pattern. With such action, the medium directing assembly also acts as a heat dissipation surface or a heat absorption surface, dependent on the direction of heat flow, wherein placement of longitudinally extended medium directing assembly, made possible with the present invention due to usage of acute angles to position a plurality of medium directing panel members comprising the medium directing assembly, permits desirable performance enhancements. Usage of acute angles, generally ranging between 3 and 42 degrees, permits the medium directing assembly to be extended longitudinally at length, generally extending the entire longitudinal span of the chamber assembly, thereby expanding heat transfer surfaces and improving the heat exchanger performance, by extension. Furthermore, as a result, the major portion of the first heat exchange medium directed into the chamber assembly through the chamber inlet is directed to impact the medium directing assembly.

The present invention retains the positive feature of a traditional tube and chamber type heat exchanger, maintaining the desired mixing and eddying effect facilitated by the medium directing assembly, creating two divergent arcuate flows as the heat exchange medium circumvents the plurality of medium directing panels laterally upon impact with the respective medium directing panel members. The divergent lateral arcuate flows created by the medium directing assembly causes the first heat exchange medium to be energized with mixing and eddying effect, thereby effectively enhancing the convective heat transfer effect of the first heat exchange medium, improving the performance of the heat exchanger by extension. Furthermore, the energized flow is utilized to facilitate mixing and eddying of the first heat exchange medium directed to flow within the flow channels provided within the chamber assembly, without the use of physical obstruction means, thereby achieving enhanced convective heat transfer without unduly increasing pressure drop effect to the first heat exchange medium. As the chamber assembly is a primary surface for heat transfer purposes, functioning as a conduit to transfer heat between the first heat exchange medium and the second heat exchange medium, the first heat exchange medium is configured to be surrounded on all vertical and lateral sides by primary surfaces, significantly increasing the ratio of use of primary surfaces over secondary surfaces, such as fins, greatly improving heat transfer performance. Generally, with the present invention, the use of secondary surfaces can be drastically minimized, if not eliminated completely.

The present invention further accomplishes the desired effect in a cost-effective and easy to manufacture manner, thereby providing means to produce highly effective heat exchanger in a cost-competitive fashion. Such a heat exchanger may be desirable for use in various heat exchange applications, such as in automotive, industrial, commercial, or consumer electronics and appliance applications, for example. The present invention may be especially desirable where packaging space provided for the heat exchanger may be generally limited, or where a reduction in weight of the heat exchanger is desired. The present invention is especially desirable in an application where a fan is utilized to facilitate the enhanced flow of the heat exchange medium, as such application is especially sensitive to pressure drop effect to the heat exchange medium.

As a result, the present invention may be well-suited for use in a radiator, a heater core, an evaporator, or a condenser application, for example. Furthermore, as the present invention does not rely upon maximization of the density of fin materials to obtain the desired heat transfer performance, which is prone to heat exchange medium flow path blockages, the heat exchanger of the present invention is especially desirable for use in an environment where the first heat exchange medium may be contaminated with foreign material, such as sand, sediment, dust, carbon residue, debris, or trash, for example.

In an embodiment of the present invention, the medium directing assembly is generally longitudinally disposed within the chamber assembly, comprising four medium directing panel members. Each of the medium directing panel members is generally planar panel material having a thickness, with a first surface and a second surface, the second surface located on an opposite side from the first surface. Each of the medium directing panel members is laterally terminated by a first lateral edge and a second lateral edge.

A first and a second medium directing panel members are located towards the chamber inlet of the chamber assembly. A first longitudinal end of a first medium directing panel member generally extends towards the chamber inlet at an inclining angle, engaging the interior surface of the chamber assembly generally towards a first vertical side, while a first longitudinal end of a second medium directing panel member extends towards the chamber inlet at a declining angle, engaging the interior surface of the chamber assembly generally towards a second vertical side. As the first longitudinal end of the respective medium directing panel members extends towards the opposite vertical ends of the chamber assembly, a space is created between the respective first longitudinal ends, allowing the flow of the first heat exchange medium therebetween. A second longitudinal end of the respective medium directing panels, on the other hand, engage each other, terminating the further longitudinal flow of the first heat exchange medium thereof.

A third and fourth medium directing panel members are located towards the chamber outlet of the chamber assembly. The third medium directing panel member generally extends longitudinally within the chamber assembly, extending towards the chamber outlet at an inclining angle, with a first longitudinal end of the third medium directing panel member located longitudinally spaced apart from the chamber inlet and the chamber outlet and further located vertically spaced apart from the interior surface of the chamber assembly. A second longitudinal end of the third medium directing panel member engages the interior surface of the chamber assembly towards the first vertical side. The fourth medium directing panel member extends longitudinally within the chamber assembly in a similar fashion, however, with a declining angle, having a second longitudinal end engaging the chamber assembly on the second vertical side. The first longitudinal ends of the respective panel members engage each other, directing the flow of the first heat exchange medium to engage the first planar surface, respectively, of the third and the fourth medium directing panel members, maximizing the physical agitation of the first heat exchange medium, thereby facilitating greater mixing effect of the first heat exchange medium, enhancing heat transfer performance of the heat exchanger by extension.

The first medium directing panel member and the second medium directing panel members are each respectively provided with the first lateral edge and the second lateral edge that is angled, and as a result placing the respective lateral edges on intersecting planes, thereby generally diverting the respective lateral edges away from the chamber assembly interior wall towards the center axis of the chamber assembly as the respective medium directing panel members extend from the first longitudinal end to the second longitudinal end. As a result, the lateral spacing between the chamber assembly interior wall and the respective medium directing panel members is greater on the second longitudinal end than on the first longitudinal end. The third medium directing panel member and the fourth medium directing panel members are each respectively provided with a first lateral edge and a second lateral edge that are similarly provided with an angle, placing the respective lateral edges on intersecting planes. However, the first lateral edge and the second lateral edge of the third and the fourth medium directing panel members are spaced apart from the chamber assembly on the first longitudinal end of the respective medium directing panel members and angled to generally direct the lateral edges towards the interior surface of the chamber assembly as the respective lateral edges extend towards the second longitudinal edge of the respective medium directing panel members. As a result, the lateral spacing between the chamber assembly and the respective medium directing panel members is greater on the first longitudinal end than on the second longitudinal end of the respective medium directing panel members.

In an embodiment of the present invention, the medium directing assembly is positioned within the chamber assembly to form a plurality of segmented zones as well as to form flow channels. As the lateral edges of the medium directing panels are angled relative to the plane established by the chamber assembly on the lateral sides, a space is formed on a first and a second lateral sides of the medium directing assembly, forming a flow channel on each of the lateral sides of the medium directing assembly. The flow channels extend the length of the chamber assembly, generally, with no physical obstruction. The medium directing assembly is further utilized to form a plurality of longitudinally segmented zones, strategically locating the four medium directing panel members to obtain the desired result. In an embodiment of the present invention, the medium directing assembly is paired to the chamber assembly in a 1:1 ratio.

A first longitudinal end of the medium directing assembly comprises the first medium directing panel member and the second medium directing panel member. Located between the chamber inlet and the first longitudinal end of the medium directing assembly is a first staging area, a hollow space provided for the first heat exchange medium utilized to coordinate the flow of the first heat exchange medium introduced into the chamber assembly. A second longitudinal end of the medium directing assembly comprises the third medium directing panel member and the fourth medium directing panel member. Located between the first longitudinal end and the second longitudinal end of the medium directing assembly is a medial chamber zone. While a first and a second longitudinal end of the medial chamber zone are defined by the first longitudinal end and the second longitudinal end of the medium directing assembly, respectively, vertical boundaries, as well as lateral boundaries of the medial chamber zone, are defined by the interior surface of the chamber assembly.

Located between the chamber outlet and the second longitudinal end of the medium directing assembly is a second staging area, a hollow space provided for the first heat exchanger medium utilized to coordinate the flow of the first heat exchange medium being discharged out of the medial chamber zone, as well as to coordinate the flow of the first heat exchange medium prior to discharge out of the chamber assembly.

In another embodiment of the present invention, a plurality of the heat exchangers may be coupled together to form a larger heat exchanger assembly. The plurality of the heat exchangers may be coupled together in a serial fashion or in a parallel fashion. In yet another embodiment of the present invention, the plurality of the heat exchangers may be coupled in a combination of serial and parallel fashion. The heat exchanger assembly may be coupled with a pair of tanks to facilitate input and then discharge of the second heat exchange medium.

In an embodiment of the present invention, various components of the heat exchanger or the heat exchanger assembly may be produced of various heat-conducting material. The various components may be produced of the same material or may be produced of dissimilar materials. Various bonding, welding, and other coupling means may be utilized to facilitate assembly. In yet another embodiment of the present invention, a portion or all the components comprising the heat exchanger may be manufactured by means of additive manufacturing technology, known in the art.

In an embodiment of the present invention, various heat exchange medium may be used as the first heat exchange medium and the second heat exchange medium. The heat exchange medium may be gas, air, or fluid. The available heat exchange medium known in the art may be utilized in various combinations, for example.

Other features and advantages of the present invention will be readily appreciated, as the same becomes better understood after reading the subsequent description taken in conjunction with the accompanying drawings.

DETAILED DESCRIPTION

Figure 1:
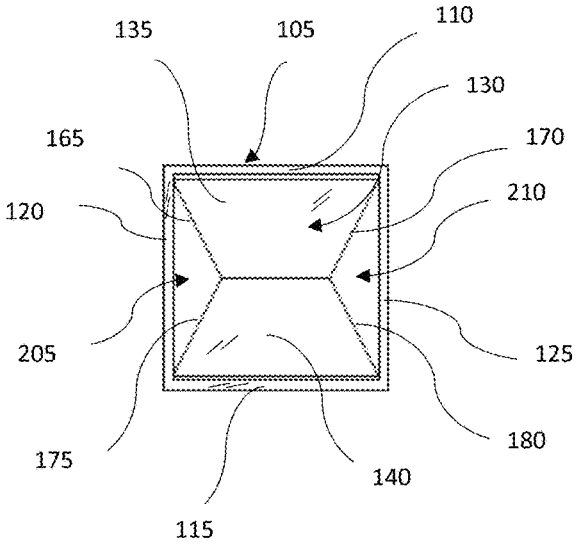
FIG. 1 is a frontal view of a heat exchanger according to an embodiment of the present invention.
Figure 3:
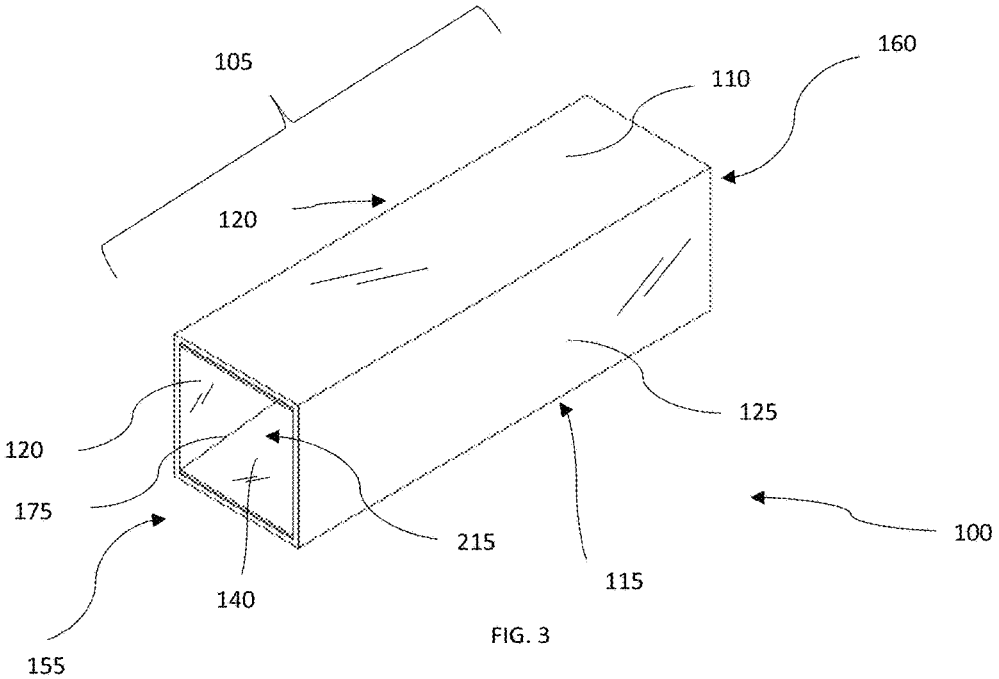
FIG. 3 is a perspective view of a heat exchanger according to an embodiment of the present invention.

Referring to the drawings and in particular FIG. 1 and FIG. 3, an embodiment of a heat exchanger 100 is shown. The heat exchanger 100 is generally for use when heat is desired to be transferred from a first heat exchange medium to a second heat exchange medium. Heat may travel into the heat exchanger 100 or out of the heat exchanger 100, dependent upon the nature of the application of the heat exchanger 100. The heat exchanger 100 is provided with a chamber assembly 105, with a chamber inlet 155 located on a first longitudinal end of the chamber assembly 105 and a chamber outlet 160 located on a second longitudinal end of the chamber assembly 105. The chamber assembly 105 is a longitudinally extended body with a hollow interior, permitting the flow of the first heat exchange medium inside the chamber assembly 105. The chamber inlet 155 is an orifice fluidly connected to the hollow interior of the chamber assembly 105, providing means to introduce the first heat exchange medium into the chamber assembly 105. The chamber outlet 160 is also an orifice, fluidly connected to the hollow interior of the chamber assembly 105, providing means to discharge the first heat exchange medium out of the chamber assembly 105.

In an embodiment of the present invention, the chamber assembly 105 may be shown generally rectangular parallelepiped shaped, comprising a plurality of planar panel members. A top vertical section of the chamber assembly 105 may be provided by a first vertical chamber panel member 110, while a bottom vertical section of the chamber assembly 105 may be provided by a second vertical chamber panel member 115, positioned vertically spaced apart from the first vertical chamber panel member 110 at a predetermined distance. A first lateral side of the chamber assembly 105 may be provided by a first lateral chamber panel member 120, while a second lateral side of the chamber assembly 105 may be provided by a second lateral chamber panel member 125, positioned laterally spaced apart from the first lateral chamber panel member 120 at a predetermined distance. The first vertical chamber panel member 110, the second vertical chamber panel member 115, the first lateral chamber panel member 120, and the second lateral chamber panel member 125 are coupled together to form a hollow chambered body. In other embodiments of the present invention, however, the chamber assembly 105 may be of other geometric shapes, such as a cylinder-like, an ovoid-like, or a polygonal prism, for example. The number of planar panels comprising the chamber assembly 105 may vary dependent on the geometric shape of the chamber assembly 105 taken in an embodiment of the present invention.

In an embodiment of the present invention, the second heat exchange medium is directed to flow outside the chamber assembly 105, to contact the exterior surface of the chamber assembly 105. The material comprising the chamber assembly 105 generally acts as a primary surface to facilitate the flow of heat between the first heat exchange medium and the second heat exchange medium. As such, it is generally desirable to select material for the chamber assembly 105 that is generally known in the art to be highly heat conductive, for example. Heat may transfer from the first heat exchange medium to the second heat exchange medium, or vice versa, dependent upon the nature of the application of the heat exchanger 100. In an embodiment of the present invention, the exterior of the chamber assembly 105 may be enclosed in a tank assembly, provided with an inlet means and an outlet means, to facilitate containment means as well as to obtain desired flow of the second heat exchange medium, for example (Not shown).

Now referring again to FIG. 1, disposed within the chamber assembly 105 is a medium directing assembly 130. The medium directing assembly 130 is generally provided as a means to facilitate desired flow pattern of the first heat exchange medium directed into the hollow interior of the chamber assembly 105, generally with a desire to improve convective heat transfer effect of the first heat exchange medium, improvement of which is generally known in the art to increase the overall performance of the heat exchanger 100. The medium directing assembly 130 is generally longitudinally disposed within the chamber assembly 105, comprising a plurality of planar panel members arranged in a specific orientation, angulation, and placement, for example, to obtain the desired convective heat transfer improvement by manipulating the flow of the first heat exchange medium in desired ways.

Figure 7:
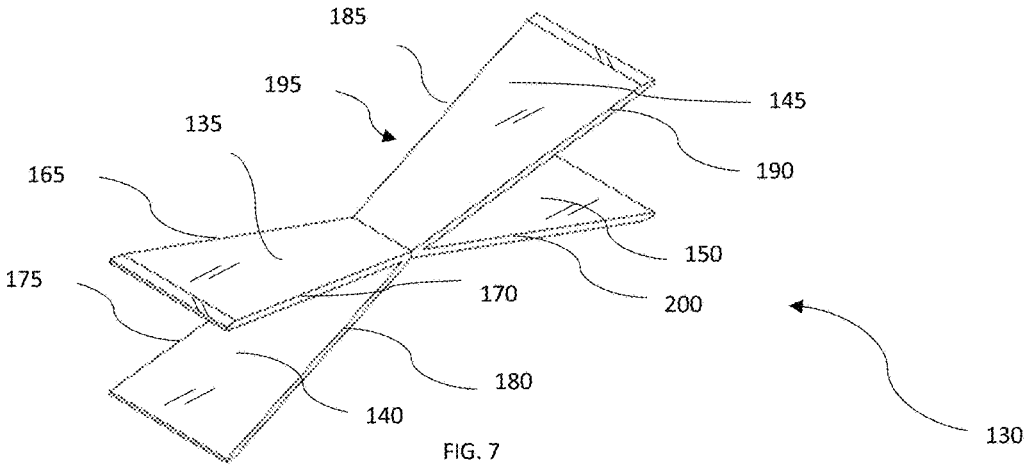
FIG. 7 is a perspective view of a medium directing assembly according to an embodiment of the present invention.

Referring now to FIG. 7, in an embodiment of the present invention, the medium directing assembly 130 may be shown comprising a first medium directing panel member 135, a second medium directing panel member 140, a third medium directing panel member 145, and a fourth medium directing panel member 150. Each respective medium directing panel members are generally planar member, having a thickness, with a first surface and a second surface, with the second surface on the opposite planar side of the first surface. Furthermore, the plurality of medium directing panel members comprising the medium directing assembly 130 is generally arranged lengthwise at a moderate acute angle, with the planes established by the respective medium directing panel members arranged at an angle generally ranging between 3 and 42 degrees relative to the planes established by the vertical panel members comprising the chamber assembly 105, within the longitudinally extended body of the chamber assembly 105, thereby permitting placement of an extended length medium directing panel members within the longitudinally extended body of the chamber assembly 105. The medium directing assembly 130 generally extend the longitudinal span of the chamber assembly 105. However, in other embodiments of the present invention, the medium directing assembly 130 may extend for at least 55% of the longitudinal span of the chamber assembly 105.

The larger surfaces afforded by the placement of longitudinally extended medium directing panel members comprising the medium directing assembly 130 is desirable, as larger surfaces enhance heat absorption efficiency or heat dissipation efficiency of the heat exchanger 100, dependent on the direction of heat travel, for example, enhancing the overall effectiveness of the heat exchanger 100. Furthermore, the placement of extended length medium directing panel members at a moderate acute angle minimize pressure drop effect to the first heat exchange medium relative to protrusions or extension members that may be used in the art, typically arranged at a steep angle of more than 45 degrees relative to the plane established by a base member to which such protrusion or extension member may be attached.

Figure 5:
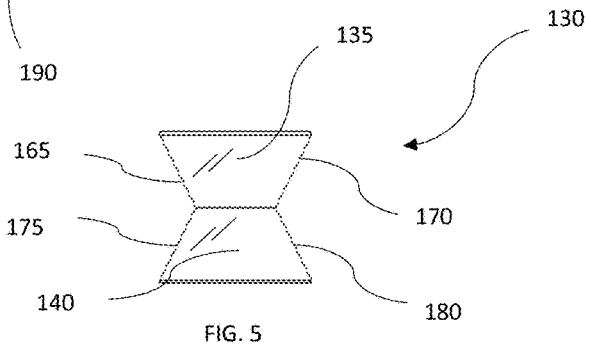
FIG. 5 is a frontal view of a medium directing assembly according to an embodiment of the present invention.

Yet furthermore, placement at a moderate acute angle permits the planar panel members to extend at length, in a longitudinal fashion within the chamber assembly 105, thereby extending the reach of the medium directing panel members to manipulate the flow of the first heat exchange medium, to generally extend for the majority of the chamber assembly 105 longitudinal span with minimal components, minimizing cost as well as simplifying assembly. Now referencing FIGS. 1 and 5, the surface area occupied by the medium directing assembly 130 relative to the surface area provided by the hollow chamber within the chamber assembly 105 when viewed facing forward the chamber inlet 155, which coincide with the transverse plane relative to the longitudinal axial characteristics established by the chamber assembly 105, is generally greater than 51%. When viewed from this plane, the space not occupied by the medium directing assembly 130 represents space allocated for a first flow path 205 and a second flow path 210. In an embodiment of the present invention, the percentage of surface area occupied by the medium directing assembly 130 relative to the surface area provided by the hollow chamber within the chamber assembly 105 when viewed facing forward the chamber inlet 155, which coincide with the transverse plane relative to the longitudinal axial characteristics established by the chamber assembly 105, is generally arranged to be in the range of between 51% and 92%, thereby facilitating greater amount of surface area for the first heat exchange medium to impact for the desired effect.

Figure 6:
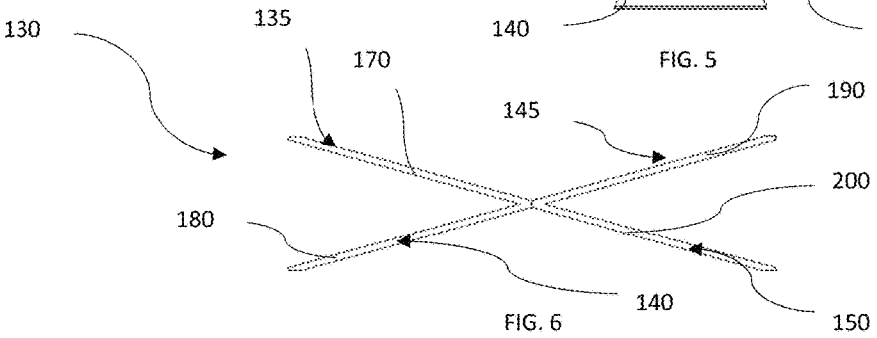
FIG. 6 is a side view of a medium directing assembly according to an embodiment of the present invention.

Referring specifically now to FIG. 6, the medium directing assembly 130 generally may be shown taking a diagonal cross shape, having a plurality of planar panel members extending in a divergent fashion from generally the center axis of the medium directing assembly 130, when observed from the side view. In an embodiment of the present invention, referring now to FIG. 8, the first medium directing panel member 135 and the second medium directing panel member 140 are generally located towards the first longitudinal end of the chamber assembly 105, generally facing the chamber inlet 155. The first medium directing panel member 135 may be shown generally vertically located above the second medium directing panel member 140. In an embodiment of the present invention, the plurality of planar panel members comprising the medium directing assembly 130 may be shown arranged in a uniform angle. However, in other embodiments of the present invention, the plurality of planar panel members may be arranged, individually, with dissimilar angles, for example (Not shown). Furthermore, in an embodiment of the present invention, the plurality of planar panel members comprising the medium directing assembly 130 may be shown to be in a uniform size. However, in other embodiments of the present invention, the plurality of planar panel members may be formed of dissimilar size or shape, for example (Not shown).

In an embodiment of the present invention, a first longitudinal end of the first medium directing panel member 135 generally extends towards the chamber inlet 155 at an inclining angle relative to the longitudinal axial characteristics established by the chamber assembly 105, the first longitudinal end engaging the interior surface of the chamber assembly 105 at the first vertical chamber panel member 110, while a first longitudinal end of the second medium directing panel member 140 similarly extends towards the chamber inlet 155, but in a declining angle, engaging the interior surface of the chamber assembly 105 (See FIG. 8) at the second vertical chamber panel member 115. As the first longitudinal end, respectively, of the first medium directing panel member 135 and the second medium directing panel member 140 extend in a divergent vertical direction, vertical spacing is formed between the first longitudinal end of the first medium directing panel member 135 and the first longitudinal end of the second medium directing panel member 140, thereby providing means to facilitate the flow of the first heat exchange medium therebetween. Furthermore, having the respective first longitudinal end of the first medium directing panel member 135 and the second medium directing panel member 140 engaging the interior surface of the chamber assembly 105, which in an embodiment of the present invention may be the first vertical chamber panel member 110 and the second vertical chamber panel member 115, respectively, the flow of the first heat exchange medium is directed towards the first planar surface, respectively, of the first medium directing panel member 135 and the second medium directing panel member 140 for the desired effect.

Yet furthermore, in an embodiment of the present invention, the first longitudinal end, respectively, of the first medium directing panel member 135 and the second medium directing panel member 140 may be shown generally aligned in a transverse plane relative to the longitudinal axial characteristics established by the chamber assembly 105. As a result, in an embodiment of the present invention, the first medium directing panel member 135 and the second medium directing panel member 140 may be shown generally symmetrical on a central plane along the center axis of the chamber assembly 105 (See FIG. 1).

Figure 8:
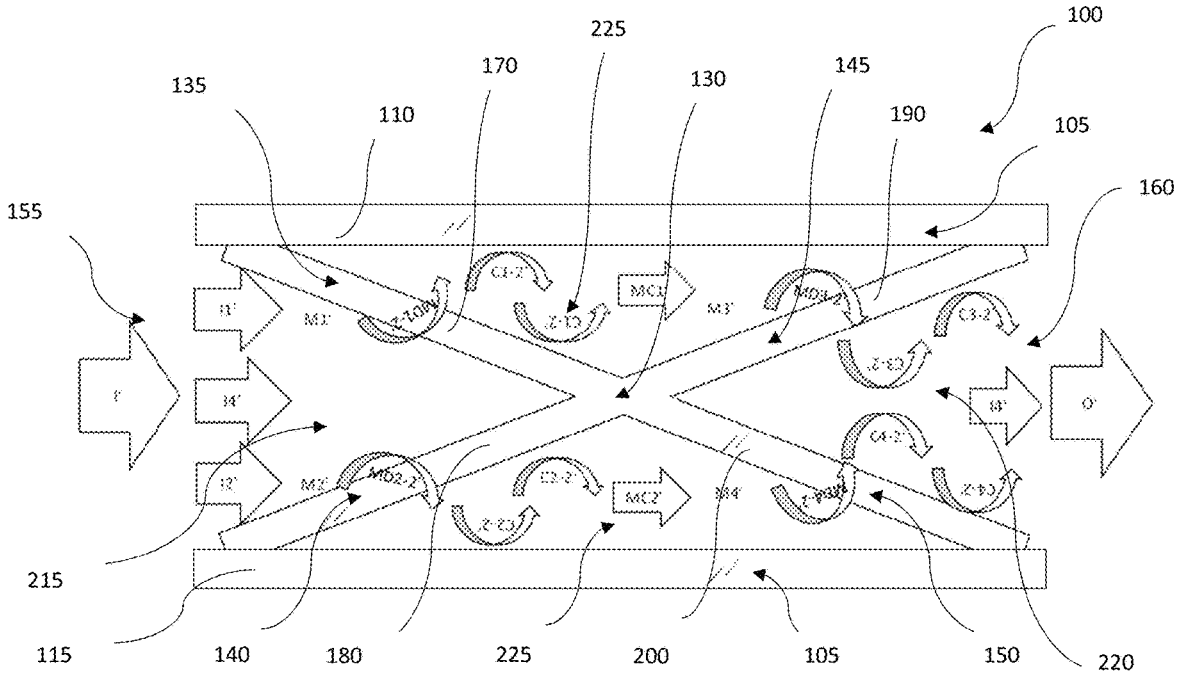
FIG. 8 is a schematic side view of a heat exchanger according to an embodiment of the present invention, illustrated with arrows a first heat exchange medium general flow pattern.

A second longitudinal end, respectively, of the first medium directing panel member 135 and the second medium directing panel member 140, in contrast, are located longitudinally spaced apart from both the chamber inlet 155 and the chamber outlet 160, and further located vertically spaced apart from the interior surface of the chamber assembly 105, specifically the first vertical chamber panel member 110 and the second vertical chamber panel member 115 in an embodiment of the present invention, thereby giving the plane established by the first medium directing panel member 135 and the plane established by the second medium directing panel member 140 an angled orientation relative to the longitudinal axial characteristics established by the chamber assembly 105, as can be readily observed in FIG. 8. In an embodiment of the present invention, the second longitudinal end, respectively, of the first medium directing panel member 135 and the second medium directing panel member 140 is shown to engage each other, thereby restricting the further longitudinal movement of the first heat exchange medium thereof. In other embodiment of the present invention, the first medium directing panel member 135 and the second medium directing panel member 140 may engage each other, but the second longitudinal end of the first medium directing panel member 135 may engage the first planar surface of the second medium directing panel member 140 at a position located between the first longitudinal end and the second longitudinal end of the second medium directing panel member 140, or vice versa, for example (Not shown).

Longitudinally disposed within the chamber assembly 105 towards the second longitudinal end, facing the chamber outlet 160, may be the third medium directing panel member 145 and the fourth medium directing panel member 150 of the medium directing assembly 130 in an embodiment of the present invention. Referring to FIG. 7, the third medium directing panel member 145 may be shown generally longitudinally axially aligned with the first medium directing panel member 135, while the fourth medium directing panel member 150 may be shown generally longitudinally axially aligned with the second medium directing panel member 140 in an embodiment of the present invention. The third medium directing panel member 145 may also be shown generally located vertically above the fourth medium directing panel member 150, thereby giving the combined structure comprising the third medium directing panel member 145 and the fourth medium directing panel member 150 a generally symmetrical appearance to the combined structure comprising the first medium directing panel member 135 and the second medium directing panel member 140, when observed from the side view (See FIG. 6), in an embodiment of the present invention.

The third medium directing panel member 145 generally extends longitudinally within the chamber assembly 105, with a first longitudinal end of the third medium directing panel member 145 located longitudinally spaced apart from both the chamber inlet 155 and the chamber outlet 160, while further vertically spaced apart from the interior surface of the chamber assembly 105, specifically the first vertical chamber panel member 110 and the second vertical chamber panel member 115, in an embodiment of the present invention. A second longitudinal end of the third medium directing panel member 145 extends towards the chamber outlet 160 at an inclining angle relative to the longitudinal axial characteristics established by the chamber assembly 105, engaging the interior surface of the chamber assembly 105 (See FIG. 8) at the first vertical chamber panel member 110, in an embodiment of the present invention.

Referring now to FIG. 8, the fourth medium directing panel member 150 similarly generally extends longitudinally within the chamber assembly 105, but in a declining angle, with a first longitudinal end of the fourth medium directing panel member 150 located longitudinally spaced apart from both the chamber inlet 155 and the chamber outlet 160, while further located vertically spaced apart from the interior surface of the chamber assembly 105, specifically the first vertical chamber panel member 110 and the second vertical chamber panel member 115 in an embodiment of the present invention. A second longitudinal end of the fourth medium directing panel member 150, meanwhile, extends towards the chamber outlet 160 at a declining angle, engaging the interior surface of the chamber assembly 105 at the second vertical chamber panel member 115, in an embodiment of the present invention.

As the plane generally established by the third medium directing panel member 145 is arranged at an inclining angle relative to the longitudinal axial characteristics established by the chamber assembly 105, while the plane generally established by the fourth medium directing panel member 150 is arranged at a declining angle, vertical spacing is provided between the second longitudinal end, respectively, of the third medium directing panel member 145 and the fourth medium directing panel member 150, thereby providing means to facilitate the flow of the first heat exchange medium therebetween. As can be observed in FIGS. 6 and 7, in an embodiment of the present invention, the first longitudinal end, respectively, of the third medium directing panel member 145 and the fourth medium directing panel member 150 may be shown engaging each other, obstructing the flow of the first heat exchange medium from flowing therebetween, in an embodiment of the present invention.

Furthermore, the plane generally established by the third medium directing panel member 145, as well as the plane established by the fourth medium directing panel member 150, are each respectively arranged at an angle relative to the longitudinal axial characteristics established by the chamber assembly 105, thereby obtaining desired flow pattern of the first heat exchange medium. Yet furthermore, in an embodiment of the present invention, the second longitudinal end, respectively, of the third medium directing panel member 145 and the fourth medium directing panel member 150 may be shown generally aligned in a transverse plane relative to the longitudinally extended axis established by the chamber assembly 105. As a result, in an embodiment of the present invention, the third medium directing panel member 145 and the fourth medium directing panel member 150 may be shown generally symmetrical on a central plane established along the center axis of the chamber assembly 105. Furthermore, having the respective second longitudinal end of the third medium directing panel member 145 and the fourth medium directing panel member 150 engaging the interior surface of the chamber assembly 105, which in an embodiment of the present invention may be the first vertical chamber panel member 110 and the second vertical chamber panel member 115, respectively, the flow of the first heat exchange medium is restricted from further longitudinal movement therefrom for the desired effect.

In an embodiment of the present invention, the four medium directing panel members of the medium directing assembly 130, comprising the first medium directing panel member 135, the second medium directing panel member 140, the third medium directing panel member 145, and the fourth medium directing panel member 150, are each respectively laterally terminated by a first lateral edge and a second lateral edge. Referring now to FIG. 7, the first medium directing panel member 135 is laterally terminated on a first lateral edge by a first directing panel first lateral edge 165, while terminated on a second lateral edge by a first directing panel second lateral edge 170. On the second medium directing panel member 140, a first lateral edge is terminated by a second directing panel first lateral edge 175, while a second lateral edge is terminated by a second directing panel second lateral edge 180. In an embodiment of the present invention, the respective lateral edges are shown to be a straight edge. However, in other embodiments of the present invention, the respective lateral edges may be shown to have an arcuate shaped edge or a jagged shaped edge, for example (Not shown).

A first longitudinal end of the first lateral edge and the second lateral edge, respectively, of the first medium directing panel member 135 and the second medium directing panel member 140, the lateral edges comprising the first directing panel first lateral edge 165, the first directing panel second lateral edge 170, the second directing panel first lateral edge 175, and the second directing panel second lateral edge 180, are generally located laterally adjacent to the interior surface of the chamber assembly 105. In an embodiment of the present invention, the first longitudinal end of the first directing panel first lateral edge 165 and the first longitudinal end of the second directing panel first lateral edge 175 may be shown generally engaging the interior surface of the chamber assembly 105 at the first lateral chamber panel member 120, while the first longitudinal end of the first directing panel second lateral edge 170 and the second directing panel second lateral edge 180 may be shown generally engaging the interior surface of the chamber assembly 105 at the second lateral chamber panel member 125 (See FIG. 9).

As such, the first longitudinal end, respectively, of the first medium directing panel member 135 and the second medium directing panel member 140 extend laterally at length generally similar to the lateral span of the hollow interior within the chamber assembly 105, in an embodiment of the present invention (See FIG. 1). However, in other embodiment of the present invention, the first longitudinal end, respectively, of the first medium directing panel member 135 and the second medium directing panel member 140 may extend laterally to be adjacent to the each respective laterally adjacent surface of the hollow interior within the chamber assembly 105, but may not engage the chamber assembly 105. In such an embodiment of the present invention, the lateral span of the first longitudinal end, respectively, of the first medium directing panel member 135 and the second medium directing panel member 140 may be arranged to be at least 80% of the lateral span provided by the hollow interior within the chamber assembly 105.

Figure 4:
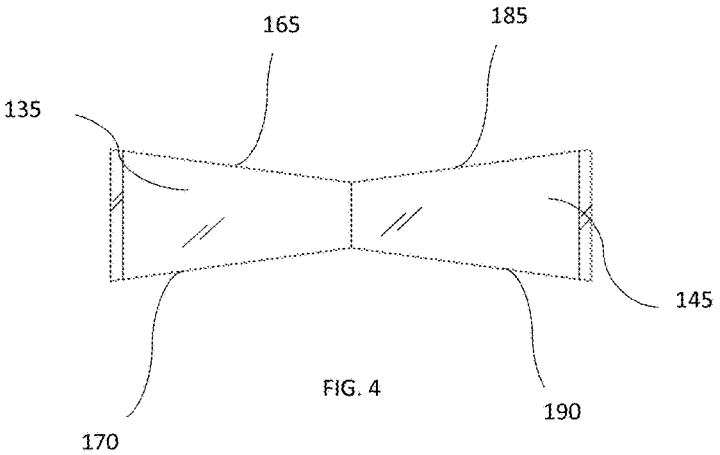
FIG. 4 is a top plan view of a medium directing assembly according to an embodiment of the present invention.
Figure 9:
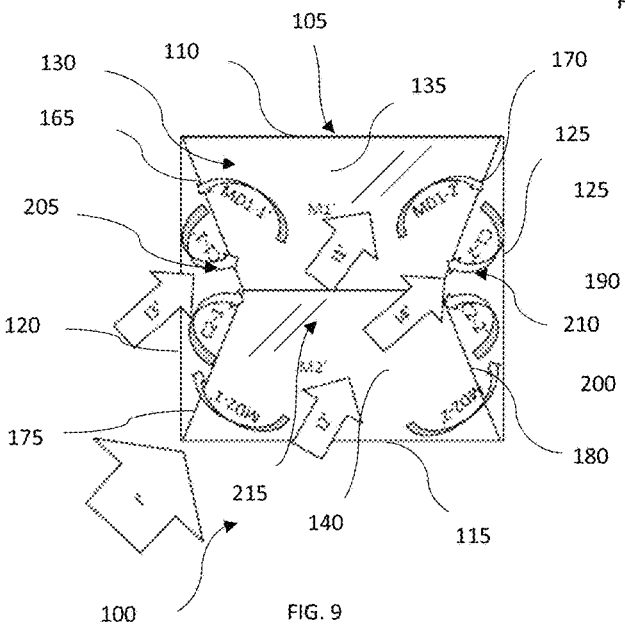
FIG. 9 is a schematic frontal view of a heat exchanger according to an embodiment of the present invention, illustrated with arrows a first heat exchange medium general flow pattern.

Furthermore, referring now to FIGS. 4 and 9, the first lateral edge and the second lateral edge, respectively, of the first medium directing panel member 135 and the second medium directing panel member 140 are located on intersecting planes, oriented at an acute angle relative to the plane established by the each respective laterally and vertically adjacent interior surface of the chamber assembly 105, thereby diverting the first lateral edge and the second lateral edge of the respective medium directing panel members away from the interior surface of the chamber assembly 105 as the respective lateral edges extend toward the second longitudinal end of the respective medium directing panel members, generally directing the respective lateral edges toward the center axis of the chamber assembly 105. In an embodiment of the present invention, the lateral edges of the respective medium directing panel members are generally angled at an acute angle, generally between 3 to 42 degrees, relative to the plane established by each respective laterally and vertically adjacent surface of the chamber assembly 105.

As a result, in an embodiment of the present invention, the first directing panel first lateral edge 165 is set at an angle relative to the plane established by the first lateral chamber panel member 120 in the lateral direction and set at an angle relative to the plane established by the first vertical chamber panel member 110 in the vertical direction. The first directing panel second lateral edge 170, on the other hand, is set at an angle relative to the plane established by the second lateral chamber panel member 125 in the lateral direction and set at an angle relative to the plane established by the first vertical chamber panel member 110 in the vertical direction. Meanwhile, the second directing panel first lateral edge 175 is set at an angle relative to the plane established by the first lateral chamber panel member 120 in the lateral direction and set at an angle relative to the plane established by the second vertical chamber panel member 115 in the vertical direction. Finally, the second directing panel second lateral edge 180 is set at an angle relative to the plane established by the second lateral chamber panel member 125 in the lateral direction and set at an angle relative to the plane established by the second vertical chamber panel member 115 in the vertical direction.

As the lateral edges of the first medium directing panel member 135 and the second medium directing panel member 140 are angled in the way previously described relative to each respectively laterally adjacent interior surface of the chamber assembly 105 as well as vertically adjacent interior surface of the chamber assembly 105, the lateral edges, comprising the first directing panel first lateral edge 165, the first directing panel second lateral edge 170, the second directing panel first lateral edge 175, and the second directing panel second lateral edge 180, provide increasing lateral and vertical spacing between the interior surface of the chamber assembly 105 and the respective lateral edges of the first medium directing panel member 135 and the second medium directing panel member 140, as the respective medium directing panel members extend longitudinally within the chamber assembly 105 towards the second longitudinal end of the chamber assembly 105.

Figure 10:
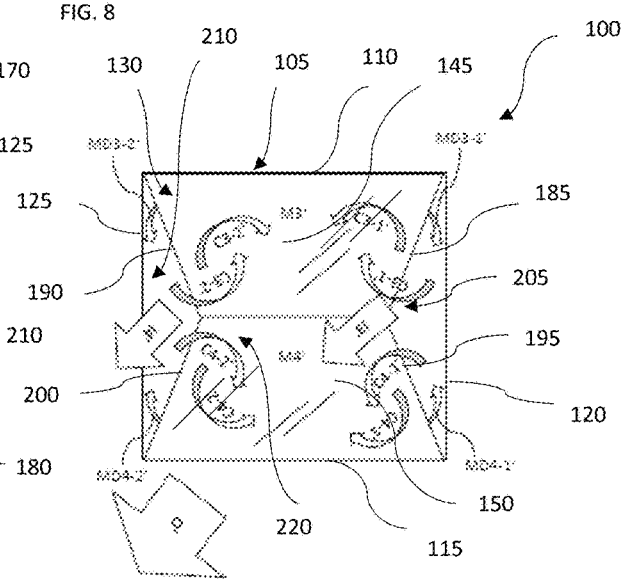
FIG. 10 is a schematic backward view of a heat exchanger according to an embodiment of the present invention, illustrated with arrows a first heat exchange medium general flow pattern.

Referring now to FIGS. 7 and 10, while the first lateral edge and the second lateral edge, respectively, of the first medium directing panel member 135 and the second medium directing panel member 140 are located on intersecting planes and are angled to divert the respective lateral edges away from the interior surface of the chamber assembly 105 towards the center axis of the chamber assembly 105 as the respective lateral edges extend towards the second longitudinal end of the chamber assembly 105, in an embodiment of the present invention, lateral edges terminating the third medium directing panel member 145 and the fourth medium directing panel member 150 generally are oriented with an opposite effect on the respective lateral edges. In an embodiment of the present invention, the respective lateral edges are shown to be a straight edge. However, in other embodiments of the present invention, the respective lateral edges may be shown to have an arcuate shaped edge or a jagged shaped edge, for example (Not shown).

Referring now to FIG. 7, the third medium directing panel member 145 is terminated on a first lateral edge by a third directing panel first lateral edge 185, while terminated on a second lateral edge by a third directing panel second lateral edge 190. On the fourth medium directing panel member 150, referring now to FIG. 10, a first lateral edge is terminated by a fourth directing panel first lateral edge 195, while terminated on a second lateral edge by a fourth directing panel second lateral edge 200. A first longitudinal end of the first lateral edge and the second lateral edge, respectively, of the third medium directing panel member 145 and the fourth medium directing panel member 150, the lateral edges comprising the third directing panel first lateral edge 185, the third directing panel second lateral edge 190, the fourth directing panel first lateral edge 195, and the fourth directing panel second lateral edge 200, are generally located vertically and laterally spaced apart from the interior surface of the chamber assembly 105, in particular, away from the first vertical chamber panel member 110 on the first vertical side and the second vertical chamber panel member 115 on the second vertical side, while located laterally away from the first lateral chamber panel member 120 on the first lateral side and the second lateral chamber panel member 125 on the second lateral side, generally locating the respective lateral edges towards the center axis of the chamber assembly 105 in an embodiment of the present invention.

Furthermore, the first lateral edge and the second lateral edge, respectively, of the third medium directing panel member 145 and the fourth medium directing panel member 150 are set generally at an angle, generally at an acute angle between 3 to 42 degrees, relative to each respectively adjacent surface of the chamber assembly 105. As a result, in an embodiment of the present invention, the third directing panel first lateral edge 185 is set at an angle relative to the plane established by the first lateral chamber panel member 120 in the lateral direction and set at an angle relative to the plane established by the first vertical chamber panel member 110 in the vertical direction.

The third directing panel second lateral edge 190, on the other hand, is set at an angle relative to the plane established by the second lateral chamber panel member 125 in the lateral direction and set at an angle relative to the plane established by the first vertical chamber panel member 110 in the vertical direction. Meanwhile, the fourth directing panel first lateral edge 195 is set at an angle relative to the plane established by the first lateral chamber panel member 120 in the lateral direction and set at an angle relative to the plane established by the second vertical chamber panel member 115 in the vertical direction. Finally, the fourth directing panel second lateral edge 200 is set at an angle relative to the plane established by the second lateral chamber panel member 125 in the lateral direction and set at an angle relative to the plane established by the second vertical chamber panel member 115 in the vertical direction.

As the lateral edges of the third medium directing panel member 145 and the fourth medium directing panel member 150 are angled in the way previously described relative to each respectively adjacent interior surface of the chamber assembly 105, the lateral edges, comprising the third directing panel first lateral edge 185, the third directing panel second lateral edge 190, the fourth directing panel first lateral edge 195, and the fourth directing panel second lateral edge 200, provide decreasing lateral and vertical spacing between the interior surface of the chamber assembly 105 and the respective lateral edges of the third medium directing panel member 145 and the fourth medium directing panel member 150, as the respective medium directing panel members extend longitudinally from the first longitudinal end towards the second longitudinal end. In an embodiment of the present invention, the second longitudinal end of the third directing panel first lateral edge 185 and the second longitudinal end of the fourth directing panel first lateral edge 195 may be shown generally engaging the interior surface of the chamber assembly 105 at the first lateral chamber panel member 120, while the second longitudinal end of the third directing panel second lateral edge 190 and the fourth directing panel second lateral edge 200 may be shown generally engaging the interior surface of the chamber assembly 105 at the second lateral chamber panel member 125 (See FIG. 10).

As a result, the second longitudinal end, respectively, of the third medium directing panel member 145 and the fourth medium directing panel member 150 extend laterally at length generally similar to the lateral span of the hollow interior within the chamber assembly 105 in an embodiment of the present invention. However, in other embodiment of the present invention, the second longitudinal end, respectively, of the third medium directing panel member 145 and the fourth medium directing panel member 150 may extend laterally to be adjacent to the each respective laterally adjacent surface of the hollow interior within the chamber assembly 105, but may not engage the chamber assembly 105. In such an embodiment of the present invention, the lateral span of the second longitudinal end, respectively, of the third medium directing panel member 145 and the fourth medium directing panel member 150 may be arranged to be at least 80% of the lateral span provided by the hollow interior within the chamber assembly 105.

Referring now to FIGS. 7 and 8, in an embodiment of the present invention, a first lateral edge of the medium directing assembly 130 comprises the first directing panel first lateral edge 165, the second directing panel first lateral edge 175, the third directing panel member first lateral edge 185, and the fourth directing panel first lateral edge 195. Respective lateral edges are arranged at an acute angle relative to the plane established by the first lateral chamber panel member 120. As a result, the first flow path 205 is formed therebetween (See FIG. 9). The first flow path 205 is a hollow space provided for the first heat exchange medium to flow, generally extending the longitudinal span of the chamber assembly 105. The first flow path 205 extends the entire longitudinal span, generally without any physical barrier or obstructions that may lead to the pressure drop effect to the flow of the first heat exchange medium.

Referring now to FIGS. 9 and 10, in an embodiment of the present invention, a second lateral edge of the medium directing assembly 130 comprises the first directing panel member second lateral edge 170, the second directing panel second lateral edge 180, the third directing panel member second lateral edge 190, and the fourth directing panel second lateral edge 200. Respective lateral edges are arranged at an acute angle relative to the plane established by the second lateral chamber panel member 125. As a result, the second flow path 210 is formed therebetween. The second flow path 210 is also a hollow space provided for the first heat exchange medium to flow, generally extending the longitudinal span of the chamber assembly 105. The second flow path 210 extends the entire longitudinal span, generally without any physical barrier or obstructions that may lead to the pressure drop effect to the flow of the first heat exchange medium.

Figure 11:
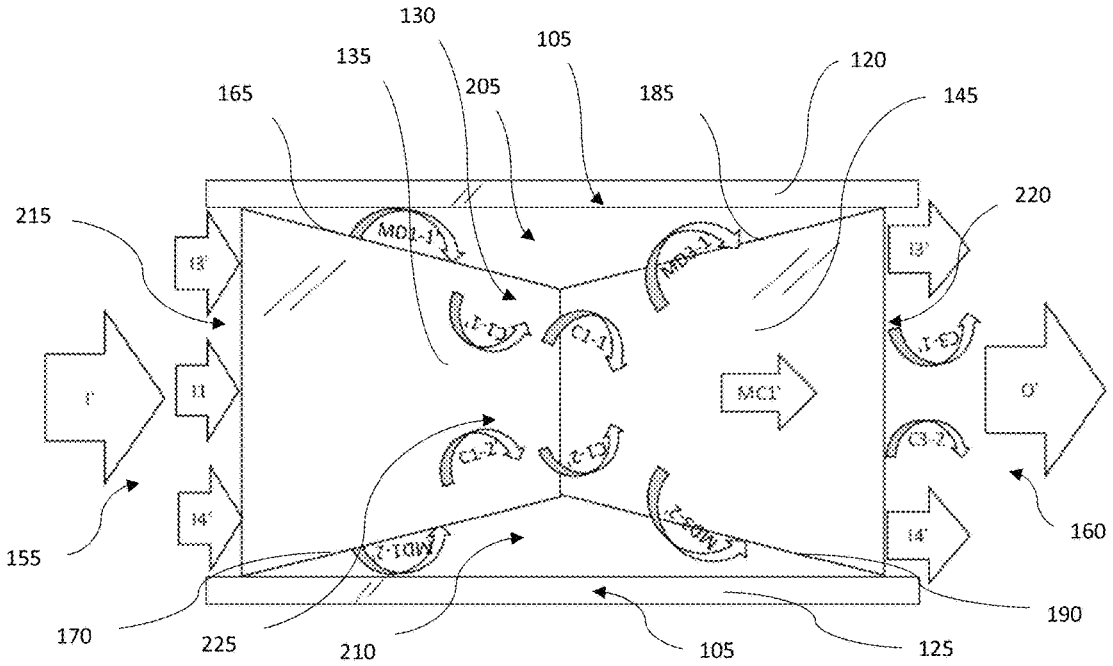
FIG. 11 is a schematic top plan view of a heat exchanger according to an embodiment of the present invention, illustrated with arrows a first heat exchange medium general flow pattern.

Now referring to FIGS. 8 and 11, a medial chamber zone 225 is defined within the chamber assembly 105, a partitioned segmented section within the hollow interior of the chamber assembly 105, facilitating desired mixing and agitating effect to the first heat exchange medium, generally known in the art to enhance convective heat transfer effect of the first heat exchange medium, thereby enhancing heat transfer effectiveness of the heat exchanger 100 by extension. A first longitudinal end of the medial chamber zone 225 is defined by the first longitudinal end of the medium directing assembly 130. In an embodiment of the present invention, the first longitudinal end of the medial chamber zone 225 may be defined by the first medium directing panel member 135 and the second medium directing panel member 140. While on a second longitudinal end, the medial chamber zone 225 is defined by the second longitudinal end of the medium directing assembly 130. In an embodiment of the present invention, the second longitudinal end of the medial chamber zone 225 may be defined by the third medium directing panel member 145 and the fourth medium directing panel member 150. The vertical boundaries as well as the lateral boundaries of the medal chamber zone 225, meanwhile, are defined by the interior surface of the chamber assembly 105. In an embodiment of the present invention, the vertical and the lateral boundaries of the medial chamber zone 225 may be defined by the first vertical chamber panel member 110, the second vertical chamber panel member 115, the first lateral chamber panel member 120, and the second lateral chamber panel member 125.

Referring now to FIGS. 8 and 9, in an embodiment of the present invention, a first staging area 215 may be defined in a space located between the chamber inlet 155 and the first longitudinal end of the medium directing assembly 130. The first staging area 215 is another partitioned segmented section within the hollow interior of the chamber assembly 105, utilized to facilitate the desired flow of the first heat exchange medium within the chamber assembly 105, as the first heat exchange medium is initially introduced into the chamber assembly 105 through the chamber inlet 155. The first staging area 215 is defined on a first longitudinal end by the chamber inlet 155, while defined by the first longitudinal end of the medium directing assembly 130 on a second longitudinal end. The vertical boundaries are also defined by the first longitudinal end of the medium directing assembly 130, while the lateral boundaries are defined by the interior surface of the chamber assembly 105. In an embodiment of the present invention, the lateral boundaries may be defined by the first lateral chamber panel member 120 and the second lateral chamber panel member 125.

Referring now to FIGS. 8 and 10, in an embodiment of the present invention, a second staging area 220 may be defined in a space located between the second longitudinal end of the medium directing assembly 130 and the chamber outlet 160. The second staging area 220 is yet another partitioned segmented section within the hollow interior of the chamber assembly 105, utilized to facilitate the desired flow of the first heat exchange medium within the chamber assembly 105, as the first heat exchange medium is discharged out of the medial chamber zone 225. Furthermore, the second staging area 220 is utilized to obtain the desired flow of the first heat exchange medium prior to discharge out of the chamber assembly 105 through the chamber outlet 160 for the desired effect. The second staging area 220 is defined on a first longitudinal end by the second longitudinal end of the medium directing assembly 130, while defined by the chamber outlet 160 on a second longitudinal end. The vertical boundaries are also defined by the second longitudinal end of the medium directing assembly 130 while the lateral boundaries are defined by the interior surface of the chamber assembly 105. In an embodiment of the present invention, the lateral boundaries may be defined by the first lateral chamber panel member 120 and the second lateral chamber panel member 125.

In an embodiment of the present invention, the initial flow of the first heat exchange medium directed inside the chamber assembly 105, shown by an arrow I' in FIG. 8, is generally introduced as a uniform, singular flow through the chamber inlet 155. As the first heat exchange medium is further directed inside the chamber assembly 105, the first heat exchange medium is directed to the first staging area 215, where the first heat exchanger medium is then diverted into divergent flow paths. Referring to FIG. 8, from the first staging area 215, the first heat exchange medium may be shown diverted into three separate and distinct flow paths, in an embodiment of the present invention, for example. Referring to FIGS. 8 and 9, from the first staging area 215, the first heat exchange medium may be directed to impact the medium directing assembly 130, shown by arrows as I1' and I2' flow. A second flow for the first heat exchange medium may be directed to flow towards the first flow path 205, shown by arrow I3', while a third flow for the first heat exchange medium may be diverted to flow towards the second flow path 210, shown by arrow I4'. The first heat exchange medium diverted to the first flow path 205 and the second flow path 210 are each a longitudinally extended flow, generally extending the longitudinal span of the chamber assembly 105. The first heat exchange medium flowing within the first flow path 205 and the second flow path 210 generally extend in a longitudinal axial manner, located generally on the first lateral side and the second lateral side, respectively, of the medium directing assembly 130, while further located adjacent to each respectively adjacent interior surface of the chamber assembly 105, in an embodiment of the present invention, the first lateral chamber panel member 120 and the second lateral chamber panel member 125, respectively, to effectively transfer heat between the first heat exchange medium and the material comprising the chamber assembly 105, which provides the primary surface facilitating heat transfer between the first heat exchange medium and the second heat exchange medium.

Unlike a typical heat exchange medium flow in a conventional heat exchanger known in the art that may utilize tubular structure to facilitate the flow of the first heat exchange medium within, in an embodiment of the present invention, as can be readily observed from the description of flow arrangement of the first heat exchange medium within the chamber assembly 105, the first heat exchange medium is directed to flow in a plurality of flow pathways that is divergent from the flow conforming to that of the longitudinal axial characteristics established by the chamber assembly 105. In a conventional heat exchanger utilizing a tubular structure, wherein a plurality of fins as well, as protruding members, may be populated, the first heat exchange medium is generally broadly applied conforming to an initial line of low generated by the tubular structure, typically conforming to the longitudinal axial characteristics of such tubular structure. As such, conventional heat exchanger is typically designed without consideration for applying the first heat exchange medium in a most effective manner. The arrangement and consideration for flow path control observed in the present invention, generally maximizing the effectiveness of the primary surface for heat conduction provided by the chamber assembly 105, for example, enhances the overall heat transfer performance of the heat exchanger 100 by extension.

Figure 2:
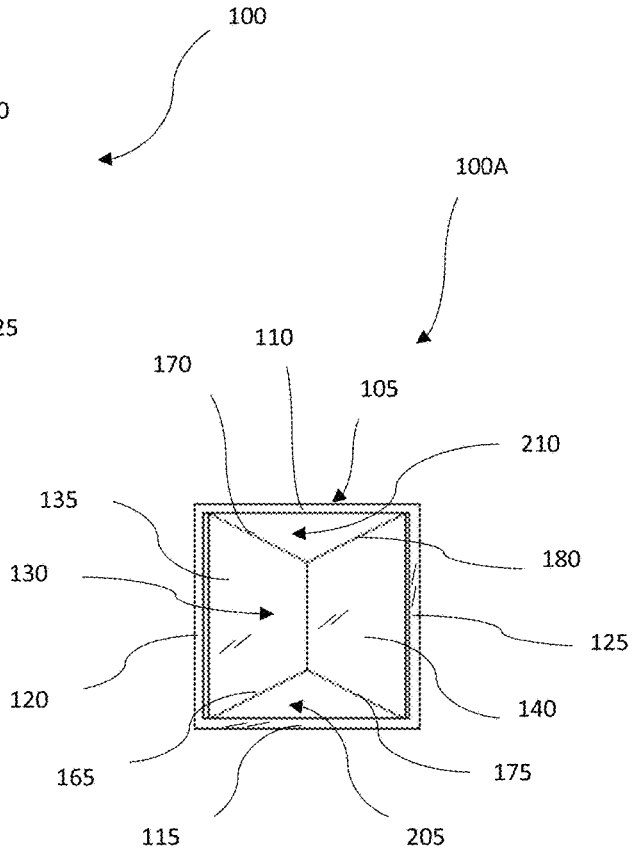
FIG. 2 is a frontal view of a heat exchanger according to another embodiment of the present invention.

In an embodiment of the present invention, referencing FIG. 1, the medium directing assembly 130 may be so positioned, locating the first flow path 205 and the second flow path 210 adjacent to the first lateral chamber panel member 120 and the second lateral chamber panel member 125, respectively. However, in other embodiments of the present invention, now referencing FIG. 2, the medium directing assembly 130 may be so positioned, locating the first flow path 205 and the second flow path 210 adjacent to the second vertical chamber panel member 115 and the first vertical chamber panel member 110, respectively. Other variations in the location of the first flow path 205 and the second flow path 210 may be possible with different locating and positioning means of the medium directing assembly 130, as well as based upon the number of chamber panel members comprising the chamber assembly 105 in other embodiments of the present invention, for example.

Referring to FIG. 9, the first heat exchange medium directed towards the medium directing assembly 130, in flow I1' and flow I2', generally impacts the first planar surface over generally the entire longitudinal span, respectively, of the first medium directing panel member 135 and the second medium directing panel member 140. In an embodiment of the present invention, the impact of the first heat exchange medium to the first planar surface, respectively, of the first medium directing panel member 135 and the second medium directing panel member 140 is especially pronounced as the second longitudinal end of the respective medium directing panel members engage each other, preventing further longitudinal movement of the first heat exchange medium therefrom.

The flow I1' and I2', upon impact with the first planar surface of the first medium directing panel member 135 and the first planar surface of the second medium directing panel member 140, respectively, are then further laterally diverted into two laterally divergent arcuate flow along the longitudinal span of respective lateral edges of the first medium directing panel member 135 and the second medium directing panel member 140. In an embodiment of the present invention, the lateral edges may comprise the first directing panel first lateral edge 165, the first directing panel second lateral edge 170, the second directing panel first lateral edge 175, and the second directing panel second lateral edge 180. As a result, the flow of the first heat exchange medium directed towards the first medium directing panel member 135 in a flow I1' may be directed into laterally divergent arcuate flow, shown as flow MD1-1' and MD1-2', upon impact with the first planar surface of the first medium directing panel member 135.

The flow MD1-1' and MD1-2' then crest over lateral edges provided by the first directing panel first lateral edge 165 and the first directing panel second lateral edge 170, respectively, which energizes the flow of the first heat exchange medium with mixing and eddying effect, now converting the flow of the first heat exchange medium as energized flow C1-1' and C1-2', respectively. In a similar fashion, the first heat exchange medium directed to impact the second medium directing panel member 140 is further diverted to two laterally divergent arcuate flow, indicated by flow MD2-1' and MD2-2', which then crests over lateral edges provided by the second directing panel first lateral edge 175 and the second directing panel second lateral edge 180, respectively, similarly energizing the flow with mixing and eddying effect, converting the flow of the first heat exchange medium as energized flow, C2-1' and C2-2', respectively.

Referring now to the first heat exchange medium flow schematics shown in FIGS. 9 and 11, the first heat exchange medium diverted in an arcuate fashion generally around the first lateral edge, respectively, of the first medium directing panel member 135 and the second medium directing panel member 140, the lateral edges comprising the first directing panel first lateral edge 165 and the second directing panel first lateral edge 175, are generally directed to impact the each respectively laterally adjacent interior surface of the chamber assembly 105, which may be the first lateral chamber panel member 120, in an embodiment of the present invention. As a result, energized flow of the first heat exchange medium originating generally around the first directing panel first lateral edge 165 as well as generally around the second directing panel first lateral edge 175, shown as C1-1' and C2-1', respectively, are generally directed to collide with the flow of the first heat exchange medium within the first flow path 205, shown as flow I3', located adjacent to the first lateral chamber panel member 120, inducing mixing and eddying effect to the first heat exchange medium flowing within the first flow path 205 as a result. The mixing effect to the first heat exchange as described generally occurs within the medial chamber zone 225, where the energized flow of the first heat exchange medium is directly vertically and laterally surrounded by primary surface for heat conduction purposes provided by the chamber assembly 105, further enhancing the performance potential of the heat exchanger 100.

Furthermore, the arcuate flow directional changes afforded by the medium directing assembly 130, the energizing effect to the first heat exchange medium, as well as the action of colliding with the first heat exchange medium flowing within the first flow path 205 introduce desirable mixing and eddying effect to the first heat exchange, improving the convective heat transfer effect of the first heat exchange medium, thereby enhancing the heat transfer performance of the heat exchanger 100, by extension. Yet furthermore, mixing and eddying effect to the first heat exchange medium is achieved while minimizing pressure drop effect to the flow of the first heat exchange medium, as mixing and eddying effect are achieved with minimal physical obstructions that may hamper the flow of the first heat exchange medium, especially within the first flow path 205 and the medial chamber zone 225, for example. The mixing and eddying effect occurring to the first heat exchange is also directed to occur adjacent to the interior surface of the chamber assembly 105, the primary surface by which heat conduction is facilitated in the heat exchanger 100, further improving the overall performance of the heat exchanger 100. Additionally, the energized flow of the first heat exchange medium is longitudinally contained on a first longitudinal end as well as on a second longitudinal end by the medium directing assembly 130, thereby utilizing the second planar side of the first medium directing panel member 135 and the second medium directing panel member 140 as well as the first planar side of the third medium directing panel member 145 and the fourth medium directing panel member 150 for heat conduction purposes, thereby facilitating further heat conduction, increasing the performance of the heat exchanger 100 by extension.

Now referring again FIGS. 9 and 11, the first heat exchange medium diverted in an arcuate fashion generally around the second lateral edge, respectively, of the first medium directing panel member 135 and the second medium directing panel member 140, the lateral edges comprising the first directing panel second lateral edge 170 and the second directing panel second lateral edge 180, are also generally directed to impact the each respectively laterally adjacent interior surface of the chamber assembly 105, which may be the second lateral chamber panel member 125 in an embodiment of the present invention. As a result, energized flow of the first heat exchange medium originating generally around the first directing panel second lateral edge 170 as well as generally around the second directing panel second lateral edge 180, shown as C1-2' and C2-2', respectively, are generally directed to collide with the flow of the first heat exchange medium within the second flow path 210, shown as flow I4', located adjacent to the second lateral chamber panel member 125, inducing mixing and eddying effect to the first heat exchange medium flowing within the second flow path 210 adjacent to the primary surface provided by the chamber assembly 105, thereby facilitating greater heat transfer effect.

The mixing of the first heat exchange medium flows generally occurs within the medial chamber zone 225, where the energized flow of the first heat exchange medium is directly vertically and laterally surrounded by primary surface for heat conduction purposes provided by the chamber assembly 105, further enhancing the performance potential of the heat exchanger 100. Additionally, the energized flow of the first heat exchange medium is longitudinally contained on a first longitudinal end as well as on a second longitudinal end by the medium directing assembly 130, thereby utilizing the second planar side of the first medium directing panel member 135 and the second medium directing panel member 140 as well as the first planar side of the third medium directing panel member 145 and the fourth medium directing panel member 150 for heat conduction purposes, thereby facilitating heat transfer, increasing the overall performance of the heat exchanger 100 by extension.

The arcuate flow directional changes afforded by the medium directing assembly 130, the energizing effect to the first heat exchange medium introducing mixing and eddying effect to the flow, the action of impacting the first heat exchange medium flowing within the second flow path 210 introduce desirable mixing and eddying effect to the first heat exchange medium, as well as the action of the energized flow of the first heat exchange medium to impact the second lateral chamber panel member 125, all improves the convective heat transfer effect of the first heat exchange medium, thereby enhancing the heat transfer performance of the heat exchanger 100, by extension.

Furthermore, mixing and eddying effect to the first heat exchange medium is achieved while minimizing pressure drop effect to the flow of the first heat exchange medium, accomplishing mixing and eddying effect while minimizing the use of physical obstructions that may hamper the flow of the first heat exchange medium, especially within the confines of the second flow path 210 and the medial chamber zone 225, for example. The mixing and eddying effect occurring to the first heat exchange is also directed to occur adjacent to the interior surface of the chamber assembly 105, further improving the overall heat transfer effect of the heat exchanger 100 by locating the energized convective heat transfer effect adjacent to the primary surface provided for heat conduction purposes by the heat exchanger 100.

Once inside the medial chamber zone 225, the energized first heat exchange medium generally originating from the lateral sides of the first medium directing panel member 135, in flow C1-1' and flow C1-2', as well as the energized first heat exchange medium generally originating from the lateral sides of the second medium directing panel member 140, in flow C2-1' and C2'-2, flow in the energized state from the first longitudinal end of the medial chamber zone 225 towards the second longitudinal end of the medial chamber zone 225, effectively utilizing the heat conducting surface provided by the chamber assembly 105.

Once the first heat exchanger medium approaches the second longitudinal end of the medial chamber zone 225, prior to discharge of the first heat exchange medium out of the medial chamber zone 225, the first heat exchange medium is directed to impact the first planar surface, respectively, of the third medium directing panel member 145 and the fourth medium directing panel member 150. In an embodiment of the present invention, the energized flow originating from the lateral sides of the first medium directing panel member 135, in flow C1-1' and flow C1-2', may be directed to impact the first planar surface of the third medium directing panel member 145 in a flow MC1', while the energized flow originating from the lateral sides of the second medium directing panel member 140, in flow C2-1' and flow C2-2', may be directed to impact the first planar surface of the fourth medium directing panel member 150 in a flow MC2'.

Referring to FIG. 8, flow MC1' and MC2', upon impact with the first planar surface, respectively, of the third medium directing panel member 145 and the fourth medium directing panel member 150, are then further laterally diverted into laterally divergent arcuate flow along the longitudinal span of each respective lateral edges of the third medium directing panel member 145 and the fourth medium directing panel member 150. In an embodiment of the present invention, the lateral edges may comprise the third directing panel first lateral edge 185, third directing panel second lateral edge 190, the fourth directing panel first lateral edge 195, and the fourth directing panel second lateral edge 200.

As a result, referring to FIG. 11, the flow of the first heat exchanger medium directed towards the third medium directing panel member 145 in flow MC1' may be directed into laterally divergent arcuate flow shown as flow MD3-1' and MD3-2' upon impact with the first planar surface of the third medium directing panel member 145. The flow MD3-1' and MD3-2' then crest over lateral edges provided by the third directing panel first lateral edge 185 and the third directing panel second lateral edge 190, respectively, which energizes the flow of the first heat exchange medium with mixing and eddying effect, now converting the flow of the first heat exchange medium as energized flow C3-1' and C3-2', respectively (See FIG. 10). In a similar fashion, the first heat exchange medium directed to impact the fourth medium directing panel member 150 is further diverted to laterally divergent arcuate flow, indicated by flow MD4-1' and MD4-2', which then crests over lateral edges provided by the fourth directing panel first lateral edge 195 and the fourth directing panel second lateral edge 200, respectively, similarly energizing the flow with mixing and eddying effect in the process, converting the flow of the first heat exchange medium as energized flow C4-1' and C4-2', respectively (See FIG. 10).

Referring now to the first heat exchange medium flow schematics shown in FIGS. 10 and 11, the first heat exchange medium diverted in an arcuate fashion generally around the first lateral edge, respectively, of the third medium directing panel member 145 and the fourth medium directing panel member 150, the lateral edges comprising the third directing panel first lateral edge 185 and the fourth directing panel first lateral edge 195, are generally directed to impact the laterally adjacent interior surface of the chamber assembly 105, which may be the first lateral chamber panel member 120, in an embodiment of the present invention. As a result, energized flow of the first heat exchange medium originating generally around the third directing panel first lateral edge 185 as well as generally around the fourth directing panel first lateral edge 195, shown as C3-1' and C4-1', respectively, are generally directed to impact the flow of the first heat exchange medium contained within the first flow path 205, shown as flow I3', located adjacent to the first lateral chamber panel member 120, inducing further mixing and eddying effect to the first heat exchange medium flowing within the first flow path 205, as well as to impact the laterally adjacent interior surface of the chamber assembly 105, which may be the first lateral chamber panel member 120, in an embodiment of the present invention.

The mixing of the flows generally occurs within the second staging area 220, where the energized flow of the first heat exchange medium is vertically defined by the second longitudinal end of the medium directing assembly 130 while laterally defined and located directly adjacent to the primary surface for heat conduction purposes provided by the chamber assembly 105, further enhancing the performance potential of the heat exchanger 100. Furthermore, the arcuate flow directional changes afforded by the medium directing assembly 130, the energizing effect to the first heat exchange medium, as well as the action of impacting the first heat exchange medium flowing within the first flow path 205 introduce desirable mixing and eddying effect to the first heat exchange, improving the convective heat transfer effect of the first heat exchange medium, thereby enhancing the heat transfer performance of the heat exchanger 100, by extension.

Yet furthermore, mixing and eddying effect to the first heat exchange medium is achieved while minimizing pressure drop effect to the flow of the first heat exchange medium, as mixing and eddying effect are achieved with minimal physical obstructions that may hamper the flow of the first heat exchange medium, especially within the first flow path 205 and the second staging area 220, for example. The mixing and eddying effect occurring to the first heat exchange is also directed to occur laterally adjacent to the interior surface of the chamber assembly 105, the primary surface by which heat conduction is facilitated in the heat exchanger 100, further improving the overall performance of the heat exchanger 100. Additionally, the energized flow of the first heat exchange medium within the second staging area 220 is longitudinally and vertically defined by the second longitudinal end of the medium directing assembly 130, thereby utilizing the second planar side, respectively, of the third medium directing panel member 145 and the fourth medium directing panel member 150 for heat conduction purposes, effectively, with the energized flow of the first heat exchange medium, thereby facilitating greater heat transfer, increasing the performance of the heat exchanger 100 as a result.

Now referring again FIGS. 10 and 11, the first heat exchange medium diverted in an arcuate fashion generally around the second lateral edge, respectively, of the third medium directing panel member 145 and the fourth medium directing panel member 150, the lateral edges comprising the third directing panel second lateral edge 190 and the fourth directing panel second lateral edge 200, are also generally directed to impact the laterally adjacent interior surface of the chamber assembly 105, which may be the second lateral chamber panel member 125 in an embodiment of the present invention.

As a result, referring FIG. 10, the energized flow of the first heat exchange medium generally originating from the third directing panel second lateral edge 190 as well as generally originating from the fourth directing panel second lateral edge 200, shown as C3-2' and C4-2', respectively, are generally directed to impact the flow of the first heat exchange medium contained within the second flow path 210, shown as flow I4', located adjacent to the second lateral chamber panel member 125, inducing further mixing and eddying effect to the first heat exchange medium flowing within the second flow path 210.

The mixing of the flows generally occurs within the medial second staging area 220, where the energized flow of the first heat exchange medium is vertically defined by the second longitudinal end of the medium directing assembly 130, while laterally defined and located directly adjacent to the primary surface for heat conduction purposes provided by the chamber assembly 105, further enhancing the performance potential of the heat exchanger 100. Additionally, the energized flow of the first heat exchange medium is longitudinally partitioned by the medium directing assembly 130 on the first longitudinal end of the second staging area 220, thereby utilizing the second planar side, respectively, of the third medium directing panel member 145 and the fourth medium directing panel member 150 for heat conduction purposes effectively with the energized flow of the first heat exchange medium, thereby facilitating greater heat transfer, increasing the performance of the heat exchanger 100 as a result.

The arcuate flow directional changes afforded by the medium directing assembly 130, the energizing effect to the first heat exchange medium, the impacting of the energized flow to the laterally adjacent the second lateral chamber panel member 125, as well as the action of impacting the first heat exchange medium flowing within the second flow path 210 introduce desirable mixing and eddying effect to the first heat exchange, improving the convective heat transfer effect of the first heat exchange medium, thereby enhancing the heat transfer performance of the heat exchanger 100, by extension. Furthermore, mixing and eddying effect to the first heat exchange medium is achieved while minimizing pressure drop effect to the flow of the first heat exchange medium, accomplishing mixing and eddying effect while minimizing the use of physical obstructions that may hamper the flow of the first heat exchange medium, especially within the confines of the second flow path 210 and the second staging area 220, for example. The mixing and eddying effect occurring to the first heat exchange is also directed to occur laterally adjacent to the interior surface of the chamber assembly 105, further improving the overall heat transfer effect of the heat exchanger 100, locating the energized first heat exchange medium adjacent to the primary surface provided for heat conduction purposes by the heat exchanger 100.

Referring to FIG. 10, once the first heat exchange medium enters the second staging area 220 in an energized state, the flow represented by C3-1', C3-2', C4-1', and C4-2', the flow of the first exchange medium extend in an energized state generally from the first longitudinal end of the second staging area 220 to the second longitudinal end of the second staging area 220. The flow of the first heat exchange medium contained within the first flow path 205 as well as the second flow path 210 enters the second staging area 220 maintaining its agitated state upon impact with the energized flow of the first heat exchanger medium. Once all flow of the first heat exchange medium reaches the second longitudinal end of the second staging area 220, the first heat exchange medium is discharged out of the chamber assembly 105 through the chamber outlet 160, in a flow O'.

Figure 12:
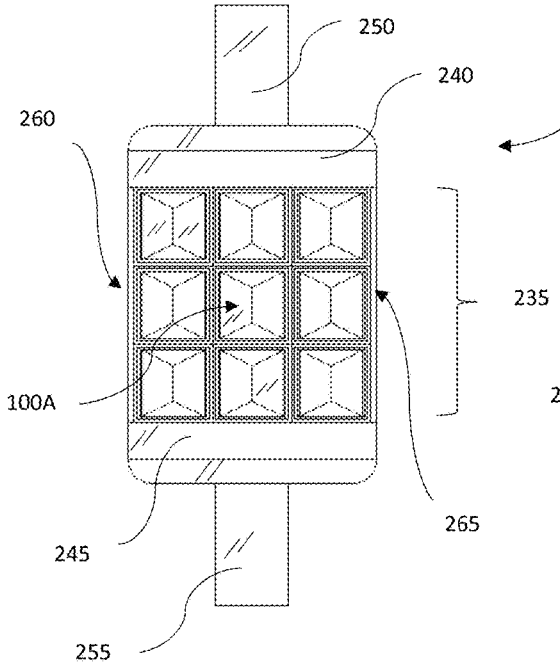
FIG. 12 is a frontal view of a heat exchanger assembly, according to an embodiment of the present invention.
Figure 13:
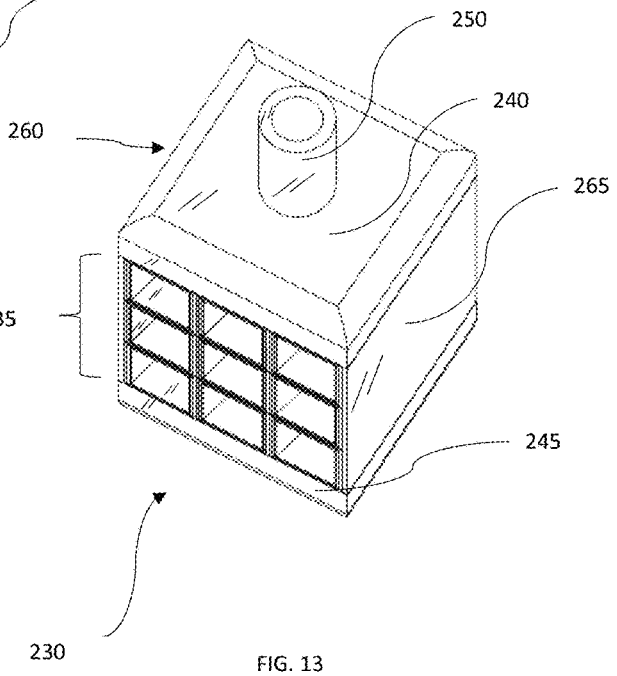
FIG. 13 is a perspective view of a heat exchanger assembly, according to an embodiment of the present invention.

Referring now to FIGS. 12 and 13, in an embodiment of the present invention, a plurality of the heat exchangers 100 may be coupled together to form a heat exchanger assembly 230. Referring specifically now to FIG. 12, as a quantity of a heat exchanger 100A combined in the heat exchanger assembly 230 is increased, the performance capacity of the heat exchanger is generally increased. As a result, the quantity of the heat exchanger 100A may be added to the heat exchanger assembly 230 to obtain the desired heat transfer performance, for example. The plurality of the heat exchanger 100A may be coupled together in a parallel fashion (See FIG. 12), or in a serial fashion (Not shown). In other embodiments of the present invention, the plurality of the heat exchanger 100 or the heat exchanger 100A may be combined in a combination of a serial and a parallel orientation (Not shown). In an embodiment of the present invention, the plurality of heat exchanger 100A in the heat exchanger assembly 230 may be shown arranged in an in-line formation relative to the positioning of the adjacent heat exchanger 100A. However, in other embodiments of the present invention, the plurality of heat exchanger 100A may be arranged in a staggered formation relative to the positioning of the adjacent heat exchanger 100A (Not shown).

Figure 14:
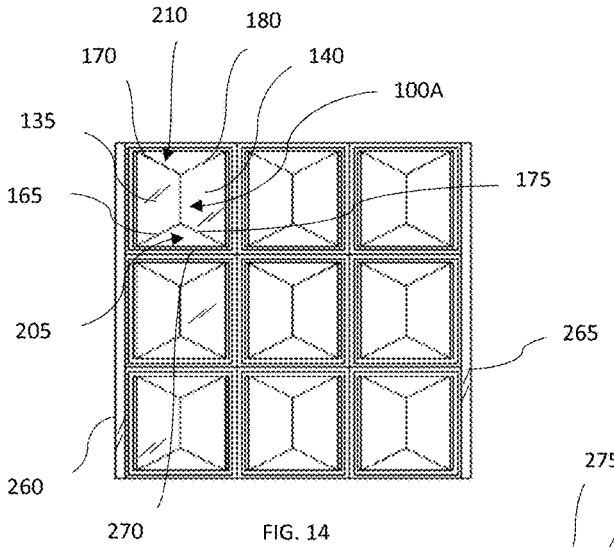
FIG. 14 is a frontal view of a heat exchanger core, according to an embodiment of the present invention.

Now referring to FIG. 14, to facilitate greater ease of assembly of the heat exchanger assembly 230, the plurality of heat exchanger 100A may be bundled together in a heat exchanger core 235. In an embodiment of the present invention, the heat exchanger 100A may be provided with a first partition sleeve 270 and a second partition sleeve 275 coupled on a first longitudinal end and a second longitudinal end, respectively, of the heat exchanger 100A. The first partition sleeve 270 and the second partition sleeve 275 are generally a hollow tubular member having an inner dimension generally conforming to the outer dimension of the heat exchanger 100A, while the outer dimension of the respective partition sleeves generally having larger outside dimension than the heat exchanger 100A, thereby giving the first partition sleeve 270 and the second partition sleeve 275 a thickness. In an embodiment of the present invention, the first partition sleeve 270 and the second partition sleeve 275 may be shown generally rectangular parallelepiped shaped. However, in other embodiments of the present invention, the respective partition sleeves may take other geometric shapes to conform to the shape of the heat exchanger 100A configured to take a different shape in other embodiments of the present invention, for example.

Figure 15:
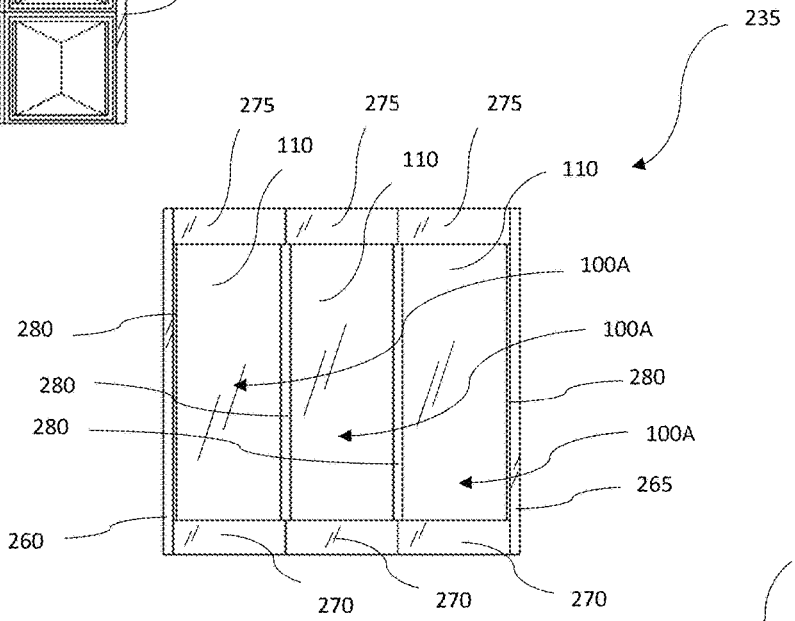
FIG. 15 is a top plan view of a heat exchanger core, according to an embodiment of the present invention.
Figure 16:
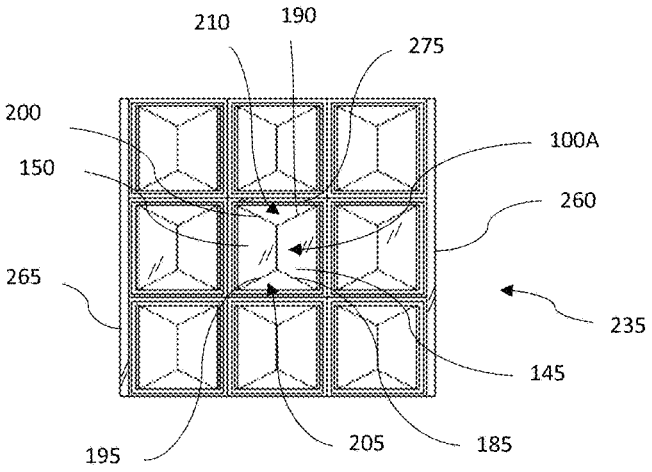
FIG. 16 is a backward view of a heat exchanger core, according to an embodiment of the present invention.
Figure 17:
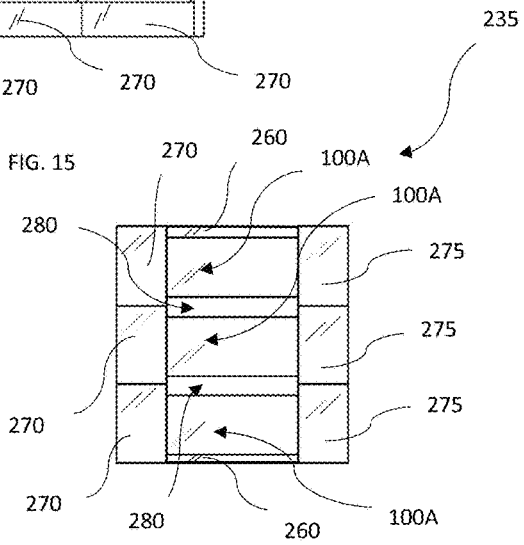
FIG. 17 is a partially broken-up side view of a heat exchanger core, according to an embodiment of the present invention (Second lateral wall 265 removed for clarity)

Referring to FIGS. 15 and 17, the first partition sleeve 270 and the second partition sleeve 275 are generally utilized in the heat exchanger core 235 to obtained desired spacing between the plurality of the heat exchanger 100A. The first partition sleeve 270 and the second partition sleeve 275 are generally set at a longitudinal length that is substantially shorter than the longitudinal length of the heat exchanger 100A, thereby providing a longitudinally extending gap between the first partition sleeve 270 and the second partition sleeve 275 once coupled to the first longitudinal end and the second longitudinal end, respectively, of the heat exchanger 100A. As a result, the first partition sleeve 270 and the second partition sleeve 275 provide desired vertical and lateral spacing, in a form of a fluid pathway 280, between the plurality of the heat exchanger 100A, when coupled together to form the heat exchanger core 235. In an embodiment of the present invention, the first partition sleeve 270 and the second partition sleeve 275 are shown to be generally having the same longitudinal span as well as material thickness. However, in other embodiments of the present invention, the first partition sleeve 270 and the second partition sleeve 275 may be provided with dissimilar longitudinal span or dissimilar material thickness for the desired effect.

Referring now to FIGS. 13 and 15, in an embodiment of the present invention, the heat exchanger assembly 230 may be provided with a first lateral wall 260 sealingly coupled to a first lateral side of the heat exchanger core 235, while provided with a second lateral wall 265 sealingly coupled to a second lateral side of the heat exchanger core 235. The first lateral wall 260 and the second lateral wall 265 are generally planar member having a thickness. The heat exchanger assembly 230 may be coupled with an inlet manifold 240, a tank member that may be provided with baffles or without baffles, on a first vertical end while coupled with an outlet manifold 245, another tank member that may be provided with baffles or without baffles, on a second vertical end of the heat exchanger assembly 230 to obtain desired flow characteristics of the second heat exchange medium directed to flow into the heat exchanger assembly 230. The inlet manifold 240 may be coupled with an inlet tube 250, a hollow tubular member, to provide means to introduce the second heat exchange medium into the heat exchanger assembly 230, while an outlet tube 255, another hollow tubular member, may be coupled to the outlet manifold 245 to provide means to discharge the second heat exchange medium out of the heat exchanger assembly 230.

In an embodiment of the present invention, the heat exchanger 100 may be paired with the medium directing assembly 130 of various configurations. The medium directing assembly 130 may be comprised of various combination of components shown in FIGS. 18, 20, 22, 24, 26, and 28, to obtain desired effect in an assembled state, shown in FIGS. 19, 21, 23, 25, 27, and 29, respectively, for example.

Figure 18:
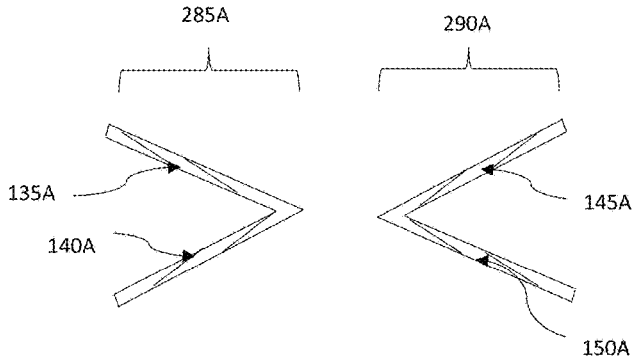
FIG. 18 is a side view of a medium directing assembly components, according to an embodiment of the present invention.
Figure 19:
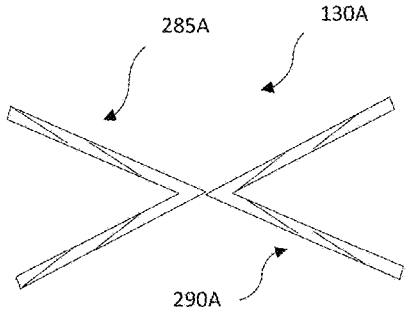
FIG. 19 is a side view of an assembled state of a medium directing assembly of the medium directing assembly components shown in FIG. 18.

Referring now to FIGS. 18 and 19, in an embodiment of the present invention, a medium directing assembly 130A may be configured combining two separate pre-configured components comprising a first assembly 285A and a second assembly 290A, for example. The first assembly 285A and the second assembly 290A comprise a plurality of generally planar panel members having a thickness coupled together. The first assembly 285A may comprise of a first medium directing panel member 135A and a second medium directing panel member 140A, arranged at a divergent angle relative to the longitudinal axial characteristics established by the chamber assembly 105, thereby having a first longitudinal end of respective medium directing panel members set apart in a vertical fashion while having a second longitudinal end of the respective medium directing panel members engaged to each other. The second assembly 290A may comprise of a third medium directing panel member 145A and a fourth medium directing panel member 150A arranged at a divergent angle relative to the longitudinal axial characteristics established by the chamber assembly 105, thereby having a first longitudinal end of respective medium directing panel members engaged to each other, while having a second longitudinal end of the respective medium directing panel members set apart in a vertical fashion.

Referring now to FIG. 19, the first assembly 285A and the second assembly 290A may be coupled together to form the medium directing assembly 130A. In an embodiment of the present invention, the first assembly 285A and the second assembly 290A may be shown generally in a symmetrical shape. However, in other embodiments of the present invention, the first assembly 285A and the second assembly 290A may be configured to take a different shape. Furthermore, the first medium directing panel member 135A, the second medium directing panel member 140A, the third medium directing panel member 145A, and the fourth medium directing panel member 150A may be configured to take varying shapes as well as angle orientation, for example.

Figure 20:
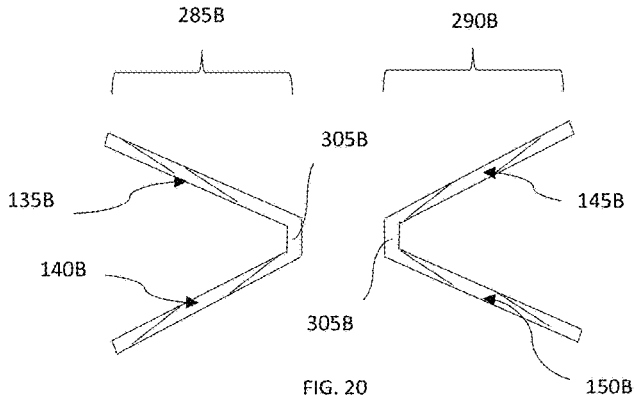
FIG. 20 is a side view of a medium directing assembly components, according to another embodiment of the present invention.
Figure 21:
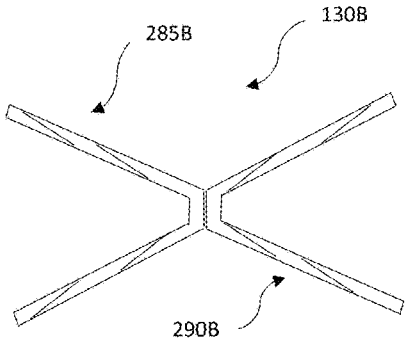
FIG. 21 is a side view of an assembled state of a medium directing assembly of the medium directing assembly components shown in FIG. 20.

Referring now to FIGS. 20 and 21, in another embodiment of the present invention, a medium directing assembly 130B may be configured combining two separate pre-configured components comprising a first assembly 285B and a second assembly 290B, for example. The first assembly 285B and the second assembly 290B comprise generally planar panel members having a thickness. The first assembly 285B may comprise of a first medium directing panel member 135B and a second medium directing panel member 140B arranged at a divergent angle relative to the longitudinal axial characteristics established by the chamber assembly 105, thereby having a first longitudinal end of respective medium directing panel members set apart in a vertical fashion while having a second longitudinal end of the respective medium directing panel members engaging, interconnected with a vertical member 305B.

In a similar fashion, the second assembly 290B may comprise of a third medium directing panel member 145B and a fourth medium directing panel member 150B arranged at a divergent angle relative to the longitudinal axial characteristics established by the chamber assembly 105, thereby having a first longitudinal end of respective medium directing panel members engaging, interconnected with the vertical member 305B, while having a second longitudinal end of the respective medium directing panel members set apart in a vertical fashion. The vertical member 305B is a planar panel member having a thickness, generally arranged in a vertical fashion relative to the longitudinal axial characteristics established by the chamber assembly 105. The vertical member 305B is especially desirable when it is desired to maintain the moderate acute angle to the medium directing panel members comprising the medium directing assembly 130B, when the longitudinal span of the chamber assembly 105 is relatively short with respect to the desired longitudinal span of the respective medium directing panel members comprising the medium directing assembly 130B.

Referring now to FIG. 21, the first assembly 285B and the second assembly 290B may be coupled together to form the medium directing assembly 130B. In an embodiment of the present invention, the first assembly 285B and the second assembly 290B may be shown generally in a symmetrical shape. However, in other embodiments of the present invention, the first assembly 285B and the second assembly 290B may be configured to take a different shape. Furthermore, the first medium directing panel member 135B, the second medium directing panel member 140B, the third medium directing panel member 145B, and the fourth medium directing panel member 150B may be configured to take varying shapes as well as angle orientation, for example.

Figure 22:
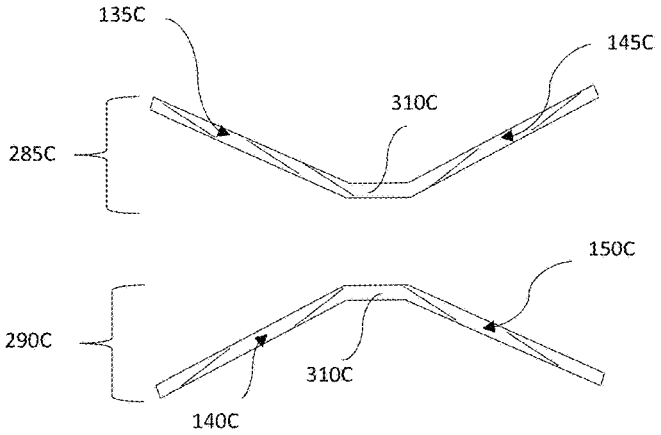
FIG. 22 is a side view of a medium directing assembly components, according to yet another embodiment of the present invention.
Figure 23:
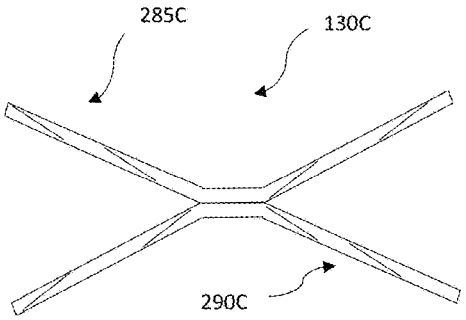
FIG. 23 is a side view of an assembled state of a medium directing assembly of the medium directing assembly components shown in FIG. 22.

Now, reference is made to FIGS. 22 and 23, in yet another embodiment of the present invention, a medium directing assembly 130C may be configured combining two separate pre-configured components comprising a first assembly 285C and a second assembly 290C, for example. The first assembly 285C and the second assembly 290C comprise generally planar panel members having a thickness. The first assembly 285C may comprise of a first medium directing panel member 135C and a third medium directing panel member 145C arranged where a second longitudinal end of the first medium directing panel member 135C and a first longitudinal end of the third medium directing panel member 145C are interconnected with a horizontal member 310C while having a first longitudinal end of the first medium directing panel member and a second longitudinal end of the third medium directing panel member 145C extend at a divergent angle relative to the longitudinal axial characteristics established by the chamber assembly 105.

In a similar fashion, the second assembly 290C may comprise of a second medium directing panel member 140C and a fourth medium directing panel member 150C arranged where a second longitudinal end of the second medium directing panel member 140C and a first longitudinal end of the fourth medium directing panel member 150C are interconnected with the horizontal member 310C while having a first longitudinal end of the second medium directing panel member 140C and a second longitudinal end of the fourth medium directing panel member 150C extend at a divergent angle relative to the longitudinal axial characteristics established by the chamber assembly 105.

In an embodiment of the present invention, the horizontal member 310C is a planar panel member with a thickness generally arranged in a horizontal fashion, generally conforming to the longitudinal axial characteristics established by the chamber assembly 105. The horizontal member 310C is especially desirable when it is desired to maintain the desired acute angle of the respective medium directing panel member comprising the medium directing assembly 130C, when the longitudinal span of the chamber assembly 105 is relatively long with respect to the desired longitudinal span of the respective medium directing panel members comprising the medium directing assembly 130C.

Referring now to FIG. 23, the first assembly 285C and the second assembly 290C may be coupled together to form the medium directing assembly 130C. In the assembled state, the second longitudinal end, respectively, of the first medium directing panel member 135C and the second medium directing panel member 140C engage each other. In a similar fashion, the first longitudinal end, respectively of the third medium directing panel member 145C and the fourth medium directing panel member 150C engage each other. In an embodiment of the present invention, the first assembly 285C and the second assembly 290C may be shown generally in a symmetrical shape. However, in other embodiments of the present invention, the first assembly 285C and the second assembly 290C may be configured to take a different shape. Furthermore, the first medium directing panel member 135C, the second medium directing panel member 140C, the third medium directing panel member 145C, and the fourth medium directing panel member 150C may be configured to take varying shape as well as angle orientation, for example.

Figure 24:
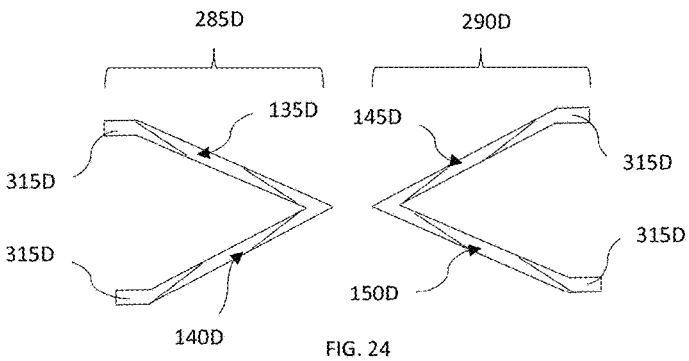
FIG. 24 is a side view of a medium directing assembly components, according to an embodiment of the present invention.
Figure 25:
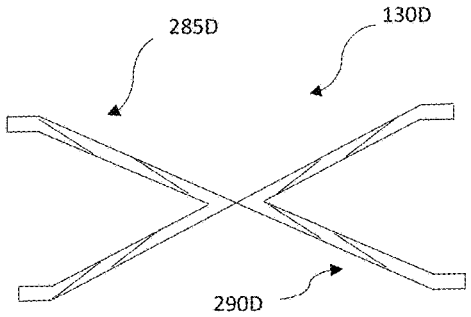
FIG. 25 is a side view of an assembled state of a medium directing assembly of the medium directing assembly components shown in FIG. 24.

Referencing FIGS. 24 and 25, in an embodiment of the present invention, a medium directing assembly 130D may be configured combining two separate pre-configured components comprising a first assembly 285D and a second assembly 290D, for example. The first assembly 285D and the second assembly 290D comprise generally planar panel members having a thickness. The first assembly 285D may comprise of a first medium directing panel member 135D and a second medium directing panel member 140D which may be arranged at a divergent angle relative to the longitudinal axial characteristics established by the chamber assembly 105, thereby having a first longitudinal end of respective medium directing panel members set apart in a vertical fashion while having a second longitudinal end of the respective medium directing panel members engage each other.

The second assembly 290D may comprise of a third medium directing panel member 145D and a fourth medium directing panel member 150D arranged at a divergent angle relative to the longitudinal axial characteristics established by the chamber assembly 105, thereby having a first longitudinal end of the respective medium directing panel members engage each other, while having a second longitudinal end of the respective medium directing panel members set apart in a vertical fashion. Furthermore, a first longitudinal end, respectively, of the first medium directing panel member 135D and the second medium directing panel member 140D, as well as a second longitudinal end, respectively, of the third medium directing panel member 145D and the fourth medium directing panel member 150D may be provided with a coupling plane 315D. The coupling plane 315D is a generally planar panel member facilitating greater contact surface between the medium directing assembly 130D and the interior surface of the chamber assembly 105. The plane established by the coupling plane 315D generally conforms to the longitudinal axial characteristics established by the inner surface of the hollow confines of the chamber assembly 105. The coupling plane 315D is especially desirable when additional structural rigidity is desired in the heat exchanger 100.

Referring now to FIG. 25, the first assembly 285D and the second assembly 290D may be coupled together to form the medium directing assembly 130D. In an embodiment of the present invention, the first assembly 285D and the second assembly 290D may be shown generally in a symmetrical shape. However, in other embodiments of the present invention, the first assembly 285D and the second assembly 290D may be configured to take a different shape. Furthermore, the first medium directing panel member 135D, the second medium directing panel member 140D, the third medium directing panel member 145D, and the fourth medium directing panel member 150D may be configured to take varying shapes as well as angle orientation, for example. The medium directing assembly 130D may be coupled together as an assembly prior to being assembled into the chamber assembly 105. In another embodiment of the medium directing assembly 130D, the first assembly 285D and the second assembly 290D may be assembled individually into the chamber assembly 105.

Figure 26:
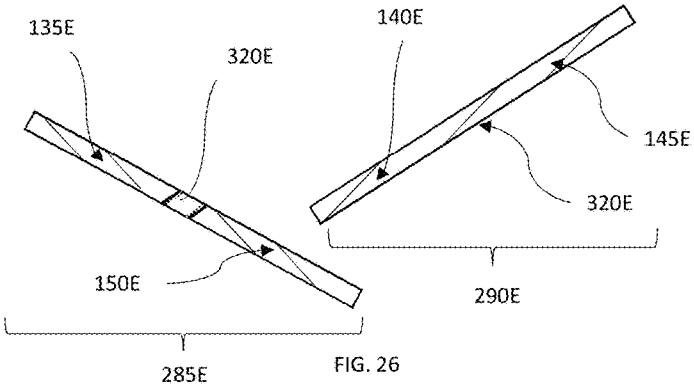
FIG. 26 is a side view of a medium directing assembly components, according to another embodiment of the present invention.
Figure 27:
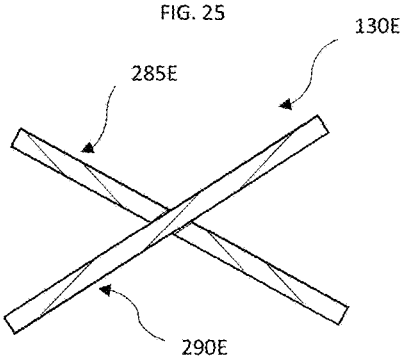
FIG. 27 is a side view of an assembled state of a medium directing assembly of the medium directing assembly components shown in FIG. 26.

Referencing is now made to FIGS. 26 and 27, where yet another embodiment of a medium directing assembly 130E is shown according to an embodiment of the present invention. The medium directing assembly 130E comprises a first assembly 285E and a second assembly 290E, wherein both the first assembly 285E and the second assembly 290E generally take a shape of a generally planar panel member with thickness. On the first assembly 285E, a first lateral edge extends the entire length generally intact, while on a second lateral edge, the second lateral edge is interrupted with a cutout 320E. The cutout 320E is a space formed, where the material is deprived to facilitate assembly. On a first longitudinal end, a first medium directing panel member 135E is formed, while on a second longitudinal end, a fourth medium directing panel member 150E is formed. The first medium directing panel member 135E and the fourth medium directing panel member 150E is, as a result, is intersected by the cutout 320E. On the second assembly 290E, a first lateral edge is interrupted with the cutout 320E, while on a second lateral edge, the second lateral edge extends the entire length generally intact. On a first longitudinal end, a second medium directing panel member 140E is formed, while on a second longitudinal end, a third medium directing panel member 145E is formed. The second medium directing panel member 140E and the third medium directing panel member 145E is, as a result, intersected by the cutout 320E.

Referring now to FIG. 27, the first assembly 285E and the second assembly 290E may be engagingly coupled to each other at the cutout 320E located on the first assembly 285E as well as on the second assembly 290E. In the assembled state, the second longitudinal end, respectively, of the first medium directing panel member 135E and the second medium directing panel member 140E engage each other. In a similar fashion, the first longitudinal end, respectively of the third medium directing panel member 145E and the fourth medium directing panel member 150E engage each other. The medium directing assembly 130E is especially desirable when the desire is to minimize cost as well as to achieve ease of manufacturing.

In an embodiment of the present invention, the first assembly 285E and the second assembly 290E may be shown generally similar in shape. However, in other embodiments of the present invention, the first assembly 285E and the second assembly 290E may be configured to take a different shape. Furthermore, the first medium directing panel member 135E, the second medium directing panel member 140E, the third medium directing panel member 145E, and the fourth medium directing panel member 150E may be configured to take varying shapes as well as angle orientation, for example.

Figure 28:
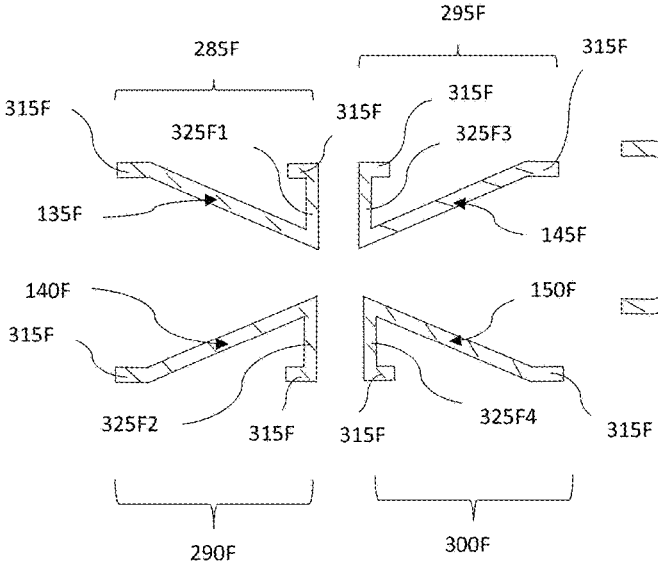
FIG. 28 is a side view of a medium directing assembly components, according to yet another embodiment of the present invention.
Figure 29:
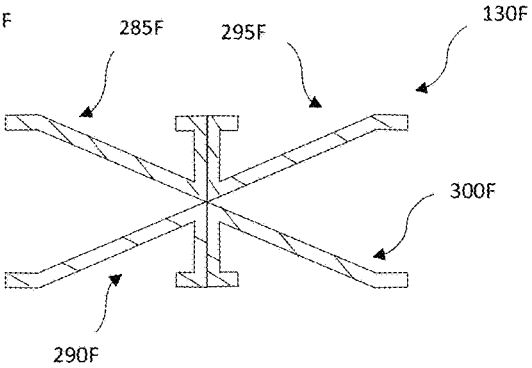
FIG. 29 is a side view of an assembled state of a medium directing assembly of the medium directing assembly components shown in FIG. 28.

Now referencing FIGS. 28 and 29, another embodiment of a medium directing assembly 130F is shown. The medium directing assembly 130F is especially desirable where individual adjustability of the various physical configuration of the medium directing assembly 130F is desired. In an embodiment of the present invention, the medium directing assembly 130F comprises a first assembly 285F, a second assembly 290F, a third assembly 295F, and a fourth assembly 300F coupled together. The first assembly 285F comprises a first medium directing panel member 135F, a generally planar panel member having a thickness arranged at an angle relative to the longitudinal axial characteristics established by the chamber assembly 105. A first longitudinal end of the first medium directing panel member 135F is coupled with a coupling plane 315F. The coupling plane 315F is a generally planar panel member having a thickness, facilitating additional contact surface with the interior surface of the chamber assembly 105.

Coupled on a second longitudinal end of the first medium directing panel member 135F is a supporting plane 325F1. The supporting plane 325F1 is a generally planar panel member having a thickness, generally arranged at a perpendicular angle relative to the longitudinal axial characteristics established by the chamber assembly 105. A first vertical end of the supporting plane 325F1 is coupled with the coupling plane 315F, while a second vertical end of the supporting plane 325F1 is coupled to the second longitudinal end of the first medium directing panel member 135F.

In a similar fashion, the second assembly 290F comprises a second medium directing panel member 140F, a generally planar panel member having a thickness arranged at an angle relative to the longitudinal axial characteristics established by the chamber assembly 105. A first longitudinal end of the second medium directing panel member 140F is coupled with the coupling plane 315F, while a second longitudinal end of the second medium directing panel member 140F is coupled with a supporting plane 325F2. The supporting plane 325F2 is a generally planar panel member having a thickness, generally arranged at a perpendicular angle relative to the longitudinal axial characteristics established by the chamber assembly 105. A first vertical end of the supporting plane 325F2 is coupled to the coupling plane 315F, while a second vertical end of the supporting plane 325F2 is coupled to the second longitudinal end of the second medium directing panel member 140F.

The third assembly 295F comprises a third medium directing panel member 145F, a generally planar panel member having a thickness arranged at an angle relative to the longitudinal axial characteristics established by the chamber assembly 105, with a first longitudinal end of the third medium directing panel member 145F coupled with a supporting plane 325F3. The supporting plane 325F3 is a generally planar panel member having a thickness, generally arranged at a perpendicular angle relative to the longitudinal axial characteristics established by the chamber assembly 105. A first vertical end of the supporting plane 325F3 is coupled with the coupling plane 315F, while a second vertical end of the supporting plane 325F3 is coupled to the first longitudinal end of the third medium directing panel member 145F. Coupled on a second longitudinal end of the third medium directing panel member 145F is the coupling plane 315F.

The fourth assembly 300F comprises a fourth medium directing panel member 150F, a generally planar panel member having a thickness arranged at an angle relative to the longitudinal axial characteristics established by the chamber assembly 105, with a first longitudinal end of the fourth medium directing panel member 150F coupled with a supporting plane 325F4. The supporting plane 325F4 is a generally planar panel member having a thickness, generally arranged at a perpendicular angle relative to the longitudinal axial characteristics established by the chamber assembly 105. A first vertical end of the supporting plane 325F4 is coupled with the coupling plane 315F, while a second vertical end of the supporting plane 325F4 is coupled to the first longitudinal end of the fourth medium directing panel member 150F. Coupled on a second longitudinal end of the fourth medium directing panel member 150F is the coupling plane 315F. In an embodiment of the present invention, the first assembly 285F, the second assembly 290F, the third assembly 295F, and the fourth assembly 300F may be shown generally similar in shape.

However, in other embodiments of the present invention, the first assembly 285F, the second assembly 290F, the third assembly 295F, and the fourth assembly 300F may be configured to take a different shape. As such, the first medium directing panel member 135F, the second medium directing panel member 140F, the third medium directing panel member 145F, and the fourth medium directing panel member 150F may be configured to take varying shapes as well as angle orientation, for example. Referring to FIG. 29, the medium directing assembly 130F may be coupled together as an assembly prior to being assembled onto the chamber assembly 105. In another embodiment of the medium directing assembly 130F, the first assembly 285F, the second assembly 290F, the third assembly 295F, and the fourth assembly 300F may be assembled individually onto the chamber assembly 105. In the assembled state, the second longitudinal end, respectively, of the first medium directing panel member 135F and the second medium directing panel member 140F engage each other. In a similar fashion, the first longitudinal end, respectively of the third medium directing panel member 145F and the fourth medium directing panel member 150F engage each other.

The present invention generally mimics the common flow path of the first heat exchange medium directed inside a typical tube and chamber type heat exchanger, with the distinction that the flow directional changes applied to the first heat exchange medium occurs generally at a moderate acute angle, typically in a longitudinally extended fashion, without drastic flow directional changes approaching close to a perpendicular angle relative to the longitudinal axial characteristic established by the chamber assembly 105, commonly seen in a typical tube and chamber type heat exchanger, thereby achieving the desired heat transfer effect without the adverse pressure drop effect to the first heat exchange medium. Minimizing pressure drop effect allows the heat exchanger 100 or the heat exchanger assembly 230 to be designed smaller while achieving the same heat transfer performance of a typical tube and chamber type heat exchanger or other conventional heat exchanger known in the art, as the first heat exchange medium is much more effectively utilized with minimal pressure drop effect.

Smaller heat exchanger design is generally desirable, as less material is needed to manufacture the heat exchanger 100 or the heat exchanger assembly 230, resulting in reduced overall cost. Furthermore, the smaller the heat exchanger 100 or the heat exchanger assembly 230 footprint, may allow for the packaging space to be smaller, generally a desirable feature in a typical application of the heat exchanger 100 or the heat exchanger assembly 230. The medium directing assembly 130 also permits the desired partitioning of the hollow space provided within the chamber assembly 105, to bring about desired flow diversion of the first heat exchange medium without the need for coupling of separate parts in a shape of a chamber inlet tube or a chamber outlet tube, typically required in a prior art tube and chamber type heat exchanger, the omission of which may lead to a reduction in cost as well as minimization of manufacturing complexity, for example.

The heat exchanger 100 or the heat exchanger assembly 230 may be utilized as a cooler, a heater, a condenser, an evaporator, a radiator, a heater core or any other application requiring heat to be transferred from the first heat exchange medium to the second heat exchange medium. The heat exchanger 100 or the heat exchanger assembly 230 may be for use in various heat exchange applications, such as in automotive, industrial, commercial, or consumer electronics and appliance applications, for example, where packaging space provided for the heat exchanger 100 or the heat exchanger assembly 230 may be generally limited or where a reduction in weight of the heat exchanger 100 or the heat exchanger assembly 230 is desired. The first heat exchange medium, as well as the second heat exchange medium utilized in the heat exchanger 100 or the heat exchanger assembly 230, may be air, liquid, or gas, known in the art. In an embodiment of the present invention, more than one type of heat exchange medium may be utilized.

In an embodiment of the present invention, various components of the heat exchanger 100 or the heat exchanger assembly 230 may be produced of ferrous or non-ferrous material. Similarly, the components may be made of plastics or composite materials. The various components may be produced of the same material or may be produced of dissimilar materials. Various bonding means may be utilized, which may include, but not limited to, welding, adhesives, epoxy, or brazing and soldering, for example. The components may also be coupled together by mechanical means, such as by crimping or folding means, for example.

In an embodiment of the present invention, various components of the heat exchanger 100 or the heat exchanger assembly 230 may be produced using various manufacturing methods known in the art. The manufacturing methods may be molding, machining, stamping, forging, or casting, for example. Furthermore, more than one manufacturing methods may be combined in an embodiment of the present invention.

In another embodiment of the present invention, various components may be welded together without additional bonding material, such as in the case of laser welding, spot welding, or ultrasonic welding, for example. In yet another embodiment of the present invention, a portion or all the components comprising the heat exchanger 100 or the heat exchanger assembly 230 may be manufactured by means of additive manufacturing technology, known in the art. A combination of various bonding and coupling means may also be utilized in an embodiment of the present invention.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A heat exchanger comprising:

a longitudinally extended chamber body defining a hollow chamber within, the chamber body provided with an inlet and an outlet for the purpose of introducing and discharging a heat exchange medium, respectively, to the chamber body, the chamber body further establishing an initial flow to the heat exchange medium; and disposed within the chamber body is a medium directing assembly, the medium directing assembly comprises a plurality of planar panel members arranged at an acute angle relative to a longitudinal axis of the chamber body, wherein a first longitudinal end of the medium directing assembly comprises a plurality of panel members arranged on a divergent plane from each other, having a first longitudinal end of the plurality of panel members engage the chamber body, while a second longitudinal end of the plurality of panel members engage each other, a second longitudinal end of the medium directing assembly comprises a plurality of panel members arranged on a divergent plane from each other, having a first longitudinal end of the plurality of panel members engage each other, while a second longitudinal end of the plurality of panel members engage the chamber body, the plurality of panel members comprising the medium directing assembly are each laterally terminated with a first lateral edge and a second lateral edge, the plurality of panel members defining the first longitudinal end of the medium directing assembly are provided with an angled first lateral edge and second lateral edge, thereby locating the second longitudinal end at a further distance away from the chamber body in a vertical and a lateral direction than on the first longitudinal end, the plurality of panel members defining the second longitudinal end of the medium directing assembly are provided with an angled first lateral edge and second lateral edge, thereby locating the first longitudinal end at a further distance away from the chamber body in a vertical and a lateral direction than on the second longitudinal end, the medium directing assembly define a plurality of flow paths extending the longitudinal span of the chamber body, further locating the plurality of flow paths between the chamber body and the medium directing assembly, the medium directing assembly define a plurality of serially interconnected partitioned chambers within the chamber body, locating at least a chamber between the inlet and the first longitudinal end of the medium directing assembly, a chamber in between the first longitudinal end and the second longitudinal end of the medium directing assembly, and a chamber located between the outlet and the second longitudinal end of the medium directing assembly, and a planar surface of the plurality of panel members defining the medium directing assembly divert the flow of the heat exchange medium in a laterally divergent arcuate flow, directing the flow of the heat exchange medium towards a corresponding adjacent flow path as well as towards a corresponding adjacent surface of the chamber body.

2. The heat exchanger according to claim 1, wherein the plurality of planar panel members defining the first longitudinal end of the medium directing assembly are provided with the first lateral edge and the second lateral edge on an intersecting plane.

3. The heat exchanger according to claim 1, wherein the plurality of planar panel members defining the second longitudinal end of the medium directing assembly are provided with the first lateral edge and the second lateral edge on an intersecting plane.

4. The heat exchanger according to claim 1, wherein the plurality of planar panel members are provided with the first lateral edge and the second lateral edge set at an acute angle relative to the plane established by the each respectively adjacent surface of the chamber body.

5. The heat exchanger according to claim 1, wherein the plurality of planar panel members are provided with the first lateral edge and the second lateral edge set at an angle between 3 to 42 degrees relative to the plane established by each respectively adjacent surface of the chamber body.

6. The heat exchanger according to claim 1, wherein the plurality of planar panel members are provided with the first lateral edge and the second lateral edge set at an angle relative to at least two separate planes established by each respectively adjacent surface of the chamber body.

7. The heat exchanger according to claim 1, wherein the plurality of planar panel members are provided with the first lateral edge and the second lateral edge set at an angle between 3 to 42 degrees relative to at least two separate planes established by each respectively adjacent surface of the chamber body.

8. The heat exchanger according to claim 1, wherein the chamber body comprises a plurality of longitudinally extended planar panel members.

9. The heat exchanger according to claim 1, wherein the plurality of flow paths are free of physical obstruction for the longitudinal span of the chamber assembly.

10. The heat exchanger according to claim 1, wherein the plurality of planar panel members defining the first longitudinal end of the medium directing assembly are symmetrical along the plane on the center axis of the chamber assembly.

11. The heat exchanger according to claim 1, wherein the plurality of planar panel members defining the second longitudinal end of the medium directing assembly are symmetrical along the plane on the center axis of the chamber assembly.

12. The heat exchanger according to claim 1, wherein the lateral span of the first longitudinal end of the plurality of planar panel members defining the first longitudinal end of the medium directing assembly is at least 80% of the lateral span of the hollow chamber within the chamber assembly.

13. The heat exchanger according to claim 1, wherein the lateral span of the second longitudinal end of the plurality of planar panel members defining the second longitudinal end of the medium directing assembly is at least 80% of the lateral span of the hollow chamber within the chamber assembly.

14. The heat exchanger according to claim 1, wherein the first longitudinal end of the plurality of planar panel members defining the first longitudinal end of the medium directing assembly is aligned on a transverse plane relative to the longitudinal axis of the chamber assembly.

15. The heat exchanger according to claim 1, wherein the second longitudinal end of the plurality of planar panel members defining the second longitudinal end of the medium directing assembly is aligned on a transverse plane relative to the longitudinal axis of the chamber assembly.

16. The heat exchanger according to claim 1, wherein at least a pair of the planar panel members defining the medium directing assembly is longitudinally aligned to each other.

17. The heat exchanger according to claim 1, wherein at least a pair of the planar panel members defining the medium directing assembly is vertically aligned to each other.

18. The heat exchanger according to claim 1, wherein a pair of the planar panel members defining the medium directing assembly is vertically aligned to each other while further longitudinally aligned to another pair of the planar panel members that are vertically aligned to each other.

19. The heat exchanger according to claim 1, wherein the chamber body is coupled to a tank assembly.

20. The heat exchanger according to claim 1, wherein the inlet and the outlet of the chamber assembly are each respectively engaged to a heat exchanger medium supply source.

21. The heat exchanger according to claim 1, wherein the first longitudinal end of the plurality of panel members defining the first longitudinal end of the medium directing assembly is coupled on opposite ends of the chamber assembly.

22. The heat exchanger according to claim 1, wherein the second longitudinal end of the plurality of panel members defining the second longitudinal end of the medium directing assembly is coupled on opposite ends of the chamber assembly.

23. The heat exchanger according to claim 1, wherein a plurality of the heat exchangers are coupled together to form a heat exchanger assembly.

24. The heat exchanger according to claim 23, wherein the plurality of the heat exchangers are each coupled with a sleeve on a first longitudinal end and a sleeve on a second longitudinal end.

25. The heat exchanger according to claim 23, wherein a plurality of tank assemblies are engagingly coupled to the heat exchanger assembly.

26. The heat exchanger according to claim 23, wherein the plurality of chamber assemblies are adjacently positioned in an in-line fashion.

27. The heat exchanger according to claim 23, wherein the plurality of chamber assemblies are adjacently positioned in a staggered fashion.

28. A heat exchanger assembly comprising:

a plurality of chamber assemblies adjacently coupled together;

a first longitudinal end of the plurality of chamber assemblies arranged to receive a first heat exchange medium in an initial flow;

the plurality of chamber assemblies each defining a hollow chamber within, the chamber assemblies each provided with an inlet and an outlet for the purpose of introducing and discharging the first heat exchange medium, respectively, to the chamber assemblies, the plurality of chamber assemblies further coupled with a sleeve on a first longitudinal end and a second longitudinal end, defining a flow path for a second heat exchange medium therebetween;

the plurality of chamber assemblies coupled with a first reservoir in fluid communication with the flow path provided for the second heat exchange medium;

the plurality of chamber assemblies coupled with a second reservoir in fluid communication with the flow path provided for the second heat exchange medium; and disposed within each of the plurality of chamber assemblies is a medium directing assembly, the medium directing assembly comprises a plurality of planar panel members arranged at an acute angle relative to a longitudinal axis of the corresponding chamber assembly, wherein a first longitudinal end of the medium directing assembly comprises a plurality of panel members arranged on a divergent plane from each other, having a first longitudinal end of the plurality of panel members engage the chamber assembly, while a second longitudinal end of the plurality of panel members engage each other, a second longitudinal end of the medium directing assembly comprises a plurality of panel members arranged on a divergent plane from each other, having a first longitudinal end of the plurality of panel members engage each other, while a second longitudinal end of the plurality of panel members engage the chamber assembly, the plurality of panel members comprising the medium directing assembly are each laterally terminated with a first lateral edge and a second lateral edge, the plurality of panel members defining the first longitudinal end of the medium directing assembly are provided with an angled first lateral edge and second lateral edge, thereby locating the second longitudinal end at a further distance away from the chamber assembly in a vertical and a lateral direction than on the first longitudinal end, the plurality of panel members defining the second longitudinal end of the medium directing assembly are provided with an angled first lateral edge and second lateral edge, thereby locating the first longitudinal end at a further distance away from the chamber assembly in a vertical and a lateral direction than on the second longitudinal end, the medium directing assembly define a plurality of flow paths for the first heat exchange medium extending the longitudinal span of the chamber assembly, further locating the plurality of flow paths between the chamber assembly and the medium directing assembly, the medium directing assembly define a plurality of serially interconnected partitioned chambers within the chamber assembly, locating at least a chamber between the inlet and the first longitudinal end of the medium directing assembly, a chamber in between the first longitudinal end and the second longitudinal end of the medium directing assembly, and a chamber located between the outlet and the second longitudinal end of the medium directing assembly, and a planar surface of the plurality of panel members defining the medium directing assembly divert the flow of the first heat exchange medium in a laterally divergent arcuate flow, directing the flow of the first heat exchange medium towards the corresponding adjacent flow path as well as towards the corresponding adjacent surface of the chamber assembly.

* * * * *